US009863662B2

(12) United States Patent
Halas et al.

(10) Patent No.: US 9,863,662 B2
(45) Date of Patent: Jan. 9, 2018

(54) GENERATING A HEATED FLUID USING AN ELECTROMAGNETIC RADIATION-ABSORBING COMPLEX

(75) Inventors: Nancy J. Halas, Houston, TX (US); Peter Nordlander, Houston, TX (US); Oara Neumann, Houston, TX (US)

(73) Assignee: William Marsh Rice University, Houston, TX (US)

( * ) Notice: Subject to any disclaimer, the term of this patent is extended or adjusted under 35 U.S.C. 154(b) by 1099 days.

(21) Appl. No.: 13/326,500

(22) Filed: Dec. 15, 2011

(65) Prior Publication Data

US 2012/0155841 A1 Jun. 21, 2012

Related U.S. Application Data

(60) Provisional application No. 61/423,278, filed on Dec. 15, 2010.

(51) Int. Cl.
*H05B 6/00* (2006.01)
*F24H 7/00* (2006.01)
(Continued)

(52) U.S. Cl.
CPC ..... *F24H 1/106* (2013.01); *F24H 1/185* (2013.01); *F24H 1/225* (2013.01); *F24H 9/2014* (2013.01)

(58) Field of Classification Search
CPC . F24H 1/10; F24H 1/106; F24H 1/185; F24H 1/225; F24H 9/2014; F15C 5/00;
(Continued)

(56) References Cited

U.S. PATENT DOCUMENTS 4,257,395 A * 3/1981 Wieder ..... 126/587
4,320,663 A 3/1982 Francia
(Continued)

FOREIGN PATENT DOCUMENTS

EP 2123968 A1 11/2009
GB 2456765 A 7/2009
(Continued)

OTHER PUBLICATIONS

Taylor Robert, et al., "Vapor Generation in a nanoparticle liquid suspension using a focused, continuous laser", Applied Physics Letters, AIP, American Institute of Physics, Melville, NY, US, vol. 95, No. 16, Oct. 21, 2009, pp. 161907-161907-3.*
(Continued)

*Primary Examiner* — Eric Stapleton
(74) *Attorney, Agent, or Firm* — Osha Liang LLP

(57) ABSTRACT

A vessel including a concentrator configured to concentrate electromagnetic (EM) radiation received from an EM radiation source and a complex configured to absorb EM radiation to generate heat. The vessel is configured to receive a cool fluid from the cool fluid source, concentrate the EM radiation using the concentrator, apply the EM radiation to the complex, and transform, using the heat generated by the complex, the cool fluid to the heated fluid. The complex is at least one of consisting of copper nanoparticles, copper oxide nanoparticles, nanoshells, nanorods, carbon moieties, encapsulated nanoshells, encapsulated nanoparticles, and branched nanostructures. Further, the EM radiation is at least one of EM radiation in an ultraviolet region of an electromagnetic spectrum, in a visible region of the electromagnetic spectrum, and in an infrared region of the electromagnetic spectrum.

13 Claims, 16 Drawing Sheets

(51) Int. Cl.

| | |
|---|---|
| ***F24H 1/10*** | (2006.01) |
| ***F24H 1/18*** | (2006.01) |
| ***F24H 1/22*** | (2006.01) |
| ***F24H 9/20*** | (2006.01) |

(58) Field of Classification Search

CPC .... F16K 99/0001; G05D 23/19; G05D 23/20; G05D 23/24; G05D 23/2422; B24B 49/105; F22B 1/02; F22B 1/28; F22B 33/18; F22B 1/006; F22B 1/281; F03G 6/00; F03G 6/06; F03G 6/065; F01K 25/06; F01K 25/065; F01K 3/186; F24J 2/4649; F24J 2/07; F24J 2/42; F24J 2/48; F24J 2/14; F24J 2/485; Y02E 10/46; Y02E 10/41; Y02B 10/20; B09B 3/0075; B09B 3/0091; A61L 2/10; A61L 11/00; A61L 2/07; C02F 11/18; C02F 2103/005; C02F 2103/30; C02F 2103/32; C02F 2209/02; C02F 2209/03; C02F 2303/04; F28F 13/187; Y02W 10/37

USPC ..... 251/129.01; 392/407, 406; 219/439; 290/52; 252/70; 977/762, 773, 810, 811; 422/108, 186.01

See application file for complete search history.

(56) References Cited

U.S. PATENT DOCUMENTS

| | | | | |
|---|---|---|---|---|
| 4,391,100 | A | 7/1983 | Smith | |
| 4,449,515 | A * | 5/1984 | Nilsson, Sr. | 126/618 |
| 4,510,922 | A | 4/1985 | Roussos et al. | |
| 4,678,332 | A | 7/1987 | Rock et al. | |
| 4,876,854 | A | 10/1989 | Owens | |
| 5,241,824 | A | 9/1993 | Parker et al. | |
| 5,408,990 | A * | 4/1995 | Edling et al. | 126/683 |
| 5,419,135 | A | 5/1995 | Wiggs | |
| 5,465,708 | A * | 11/1995 | Goebel et al. | 126/635 |
| 5,806,955 | A * | 9/1998 | Parkyn et al. | 362/612 |
| 5,806,985 | A | 9/1998 | Emig | |
| 6,245,294 | B1 | 6/2001 | Goldberg et al. | |
| 6,344,272 | B1 | 2/2002 | Oldenburg et al. | |
| 6,514,767 | B1 | 2/2003 | Natan | |
| 6,530,944 | B2 | 3/2003 | West et al. | |
| 6,614,533 | B1 | 9/2003 | Hata | |
| 6,685,986 | B2 | 2/2004 | Oldenburg et al. | |
| 6,695,974 | B2 * | 2/2004 | Withers et al. | 252/70 |
| 6,699,724 | B1 | 3/2004 | West et al. | |
| 6,778,316 | B2 | 8/2004 | Halas et al. | |
| 7,009,536 | B1 | 3/2006 | Gaus, Jr. | |
| 7,144,627 | B2 * | 12/2006 | Halas | A61K 41/0042 428/403 |
| 7,247,953 | B1 | 7/2007 | Schmulewitz | |
| 7,351,588 | B2 * | 4/2008 | Poponin | G01N 21/658 356/301 |
| 7,371,457 | B2 | 5/2008 | Oldenburg et al. | |
| 7,498,548 | B2 * | 3/2009 | Opperman | 219/695 |
| 8,430,093 | B1 * | 4/2013 | Harris | 126/685 |
| 8,507,785 | B2 * | 8/2013 | Layton | G02B 5/008 136/244 |
| 8,572,968 | B2 | 11/2013 | Schaal | |
| 8,618,481 | B2 * | 12/2013 | Nikoobakht | B81B 3/0081 250/338.1 |
| 2002/0093439 | A1 | 7/2002 | Lundin et al. | |
| 2003/0025917 | A1 | 2/2003 | Suhami | |
| 2003/0107741 | A1 | 6/2003 | Pyo et al. | |
| 2003/0187330 | A1 | 10/2003 | Abe | |
| 2003/0232445 | A1 | 12/2003 | Fulghum | |
| 2005/0052649 | A1 | 3/2005 | Tsujita | |
| 2005/0126170 | A1 | 6/2005 | Litwin | |
| 2005/0269316 | A1 | 12/2005 | Monteleone et al. | |
| 2005/0270528 | A1 | 12/2005 | Geshwind et al. | |
| 2006/0033026 | A1 | 2/2006 | Treado et al. | |
| 2006/0072109 | A1 | 4/2006 | Bodkin et al. | |
| 2006/0092070 | A1 | 5/2006 | Moore | |
| 2006/0113179 | A1 | 6/2006 | Hausmann | |
| 2006/0140462 | A1 | 6/2006 | Saggau et al. | |
| 2006/0141268 | A1 * | 6/2006 | Kalkan | B82Y 30/00 428/446 |
| 2008/0043314 | A1 | 2/2008 | Hagler | |
| 2008/0138253 | A1 | 6/2008 | Golder et al. | |
| 2008/0202498 | A1 * | 8/2008 | Ramos | 126/626 |
| 2008/0241262 | A1 | 10/2008 | Lee et al. | |
| 2008/0266686 | A1 | 10/2008 | Dengel | |
| 2008/0304609 | A1 | 12/2008 | Losic | |
| 2008/0308403 | A1 | 12/2008 | Maloney et al. | |
| 2008/0318031 | A1 | 12/2008 | Smith | |
| 2009/0179429 | A1 | 7/2009 | Ellis et al. | |
| 2009/0269505 | A1 * | 10/2009 | Lee | H05K 3/102 427/532 |
| 2009/0294692 | A1 * | 12/2009 | Bourke et al. | 250/459.1 |
| 2009/0302029 | A1 * | 12/2009 | Krishna | A61N 5/00 219/678 |
| 2009/0304905 | A1 * | 12/2009 | Graham | B05D 3/0254 427/8 |
| 2010/0043779 | A1 * | 2/2010 | Ingram | 126/694 |
| 2010/0126566 | A1 | 5/2010 | Ji | |
| 2010/0199975 | A1 * | 8/2010 | Bailey | 126/617 |
| 2011/0036431 | A1 | 2/2011 | Lee | |
| 2011/0048006 | A1 | 3/2011 | Cap et al. | |
| 2011/0180385 | A1 * | 7/2011 | Imholt | 204/157.15 |
| 2011/0185728 | A1 * | 8/2011 | Meyers | F24J 2/07 60/641.11 |
| 2011/0215298 | A1 | 9/2011 | Kim et al. | |
| 2011/0226440 | A1 | 9/2011 | Bissell et al. | |
| 2011/0240104 | A1 | 10/2011 | Lee et al. | |
| 2011/0282498 | A1 * | 11/2011 | Freudenberger et al. | 700/282 |
| 2012/0156102 | A1 | 6/2012 | Halas et al. | |
| 2012/0267893 | A1 | 10/2012 | Halas et al. | |
| 2013/0075699 | A1 | 3/2013 | Brown et al. | |
| 2013/0294729 | A1 * | 11/2013 | Layton | B82Y 20/00 385/40 |

FOREIGN PATENT DOCUMENTS

| | | | |
|---|---|---|---|
| JP | H04-31720 | A | 2/1992 |
| JP | H08-193884 | A | 7/1996 |
| JP | 2000-329617 | A | 11/2000 |
| JP | 2003-284687 | A | 10/2003 |
| JP | 2005-062104 | A | 3/2005 |
| JP | 2006-504140 | A | 2/2006 |
| JP | 2007-199572 | A | 8/2007 |
| RU | 70575 | U1 | 1/2008 |
| WO | 93/00781 | A1 | 1/1993 |
| WO | 99/06322 | A1 | 2/1999 |
| WO | WO 9906322 | A1 * | 2/1999 |
| WO | 2004/038461 | A2 | 5/2004 |
| WO | 2008/104900 | A2 | 9/2008 |
| WO | 2009/012397 | A2 | 1/2009 |
| WO | 2009/114567 | A1 | 9/2009 |
| WO | 2012/082364 | A1 | 6/2012 |
| WO | 2013/010271 | A1 | 1/2013 |

OTHER PUBLICATIONS

WO 9906322 A1 Machine Translation (Translated May 14, 2015).*

Office Action issued in related U.S. Appl. No. 13/514,762 dated Jan. 15, 2015 (22 pages).

Taylor, R., Phelan, P., Otanicar, T., Adrian, R., and Prasher, R; "Vapor Generation in a Nanoparticle Liquid Suspension Using a Focused, Continuous Laser," Applied Physics Letters, AIP, American Institute of Physics, vol. 95, No. 16, Oct. 21, 2009 (3 pages).

International Search Report for PCT/US2010/060477 dated Mar. 2, 2012 (3 pages).

International Search Report for PCT/US2011/062507 dated Mar. 6, 2012 (3 pages).

International Search Report for PCT/US2011/062497 dated Mar. 6, 2012 (3 pages).

International Preliminary Report on Patentability and Written Opinion for PCT/US2010/060477 dated Jun. 28, 2012 (11 pages).

(56) References Cited

OTHER PUBLICATIONS

International Report on Patentability issued in PCT/US2011/082497 dated Jun. 18, 2013 (9 pages).
International Report on Patentability issued in PCT/US2011/082507 dated Jun. 18, 2013 (8 pages).
Rizia Bardhan et al.; "Nanoscale Control of Near-Infrared Fluorescence Enhancement Using Au Nanoshells"; Small; vol. 4; No, 10; pp. 1716-1722, 2008 (7 pages).
Robert Content; "Slicer system of KMOS"; New Astronomy Reviews; vol. 50; pp. 374-377; 2006 (4 pages).
R. H. Fowler; "The Analysis of Photoelectric Sensitivity Curves for Clean Metals at Various Temperatures"; Physical Review; vol. 38; pp. 45-56; 1931 (12 pages).
R. H. Berg; "Evaluation of spectral imaging for plant cell analysis"; Journal of Microscopy; vol. 214; Pt 2; pp. 174-181; May 2004 (8 pages).
Rusty Lansford et al.; "Resolution of multiple green fluorescent protein color variants and dyes using two-photon microscopy and imaging spectroscopy"; Journal of Biomedical Optics; vol. 6; No. 3; pp. 311-318; Jul. 2001 (8 pages).
Robert Silbey; "Electronic Energy Transfer in Molecular Crystals"; Ann. Rev. Phys. Chem.; vol. 27; pp. 203-223; 1976 (21 pages).
Regina Soufli et al.; "Smoothing of diamond-turned substrates for extreme ultraviolet illuminators"; Optical Engineering; vol. 43; No. 12; pp. 3089-3095; Dec. 2004 (7 pages).
Robert T. Kester et al.; "Real-Time Hyperspectral Endoscope for Early Cancer Diagnostics"; Proc. of SPIE; vol. 7555; pp. 75550A-1 to 75550A-12; 2010 (12 pages).
Robert T. Kester et al.; "Development of image mappers for hyperspectral biomedical imaging applications"; Applied Optics; vol. 49; No. 10; pp. 1886-1899; Apr. 1, 2010 (14 pages).
Riley W. Aumiller et al.; "Snapshot imaging spectropolarimetry in the visible and infrared"; Proceedings of SPIE; vol. 6972; pp. 69720D-1 to 69720D-9; 2008 (9 pages).
Ralph Weissleder et al.; "In vivo imaging of tumors with protease-activated near-infrared fluorescent probes"; Nature Biotechnology; vol. 17; pp. 375-378; Apr. 1999 (4 pages).
Ralph Weissleder; "A clearer vision for in vivo imaging"; Nature Biotechnology; vol. 19; pp. 316-317; Apr. 2001 (2 pages).
Serena A. Corr et al.; "Multifunctional Magnetic-fluorescent Nanocomposites for Biomedical Applications"; Nanoscale Res Lett; vol. 3; pp. 87-104; 2008 (18 pages).
Scott A. Mathews; "Design and fabrication of a low-cost, multispectral imaging system"; Applied Optics; vol. 47; No. 28; pp. F71-F76; Oct. 2008 (6 pages).
S.J. Oldenburg et al; "Nanoengineering of optical resonances"; Chemical Physics Letters; vol. 288; pp. 243-247; 1998 (5 pages).
Surbhi Lal et al; "Nanoshell-Enabled Photothermal Cancer Therapy: Impending Clinical Impact"; Accounts of Chemical Research; vol. 41; No. 12; pp. 1842-1851, Dec. 2008 (11 pages).
Sophie Laurent et al.; "Magnetic Iron Oxide Nanoparticles: Synthesis, Stabilization, Vectorization, Physicochemical Characterizations, and Biological Applications"; Chemical Reviews; vol. 108; pp. 2064-2110; 2008 (47 pages).
Susan M. Janicki et al.; "From Silencing to Gene Expression: Real-Time Analysis in Single Cells"; Cell; vol. 116; pp. 683-698; Mar. 5, 2004 (16 pages).
Simon M. Sze et al.; "Physics of Semiconductor Devices, 3rd Edition"; John Wiley & Sons Inc.; pp. 176, 228, 352-358, 437, 450-452; 2007 (13 pages).
Steen Mørup; "Spin-canting and transverse relaxation at surfaces and in the interior of ferrimagnetic particles"; Journal of Magnetism and Magnetic Materials; vol. 266; pp. 110-118; 2003 (9 pages).
Stephen P. Todd et al., "A cryogenic image slicing IFU for UKIRT—manufacture, alignment, laboratory testing and data reduction"; Proceedings of SPIE; vol. 4842; pp. 151-161; 2003 (11 pages).
S. Vives et al.; "New technological developments in Integral Field Spectroscopy"; Proc. of the SPIE; vol. 7018; 2008 (10 pages).
S. Vives et al.; "Original image slicer designed for integral field spectroscopy with the near-infrared spectrograph for the James Webb Space Telescope"; Optical Engineering; vol. 45; No. 9; pp. 093001-1 to 093001-6; Sep. 2006 (6 pages).
Sterile Processing University, LLC; "Steam Sterilization"; http://www.spdceus.com/pdf/steam_sterilization.pdf; 2007 (6 pages).
Tatjana Atanasijevic et al.; "Calcium-sensitive MRI contrast agents based on superparamagnetic iron oxide nanoparticles and calmodulin"; PNAS; vol. 103; No. 40; pp. 14707-14712; Oct. 3, 2006 (6 pages).
T. Inagaki et al.; "Photoacoustic observation of nonradiative decay of surface plasmons in silver"; Physical Review B; vol. 24; No. 6; pp. 3644-3646; 1981 (3 pages).
T. Inagaki et al.; "Photoacoustic study of surface plasmons in metals"; Applied Optics; vol. 21; No. 5; pp. 949-954; Mar. 1, 1982 (6 pages).
Tsutomu Ishi et al.; "Si Nano-Photodiode with a Surface Plasmon Antenna"; Japanese Journal of Applied Physics; vol. 44; No. 12; pp. L364-L366; 2005 (3 pages).
Timo Zimmermann et al.; "Minireview: Spectral imaging and its applications in live cell microscopy"; FEBS Letters; vol. 546; pp. 87-92; 2003 (6 pages).
The National Academies Press; "Seeing Photons: Progress and Limits of Visible and Infrared Sensor Arrays"; Committee on Developments in Detector Technologies; National Research Council; 2010 (195 pages).
Tuan Vo-Dinh et al.; "A Hyperspectral Imaging System for In Vivo Optical Diagnostics"; IEEE Engineering in Medicine and Biology Magazine; pp. 40-49; Sep./Oct. 2004 (10 pages).
Valerie Benoit et al.; "Regulation of HER-2 oncogene expression by cyclooxygenase-2 and prostaglandin E2"; Oncogene; vol. 23; pp. 1631-1635; 2004 (5 pages).
Vicki L. Sutherland et al., "Advanced imaging of multiple mRNAs in brain tissue using a custom hyperspectral imager and multivariate curve resolution"; Journal of Neuroscience Methods; vol. 160; pp. 144-148; 2007 (5 pages).
Vasilis Ntziachristos et al.; "Fluorescence imaging with near-infrared light: new technological advances that enable in vivo molecular imaging"; Eur Radiol; vol. 13; pp. 195-208; 2003 (14 pages).
Vasilis Ntziachristos et al.; "Looking and listening to light: the evolution of whole-body photonic imaging"; Nature Biotechnology; vol. 23; No. 3; pp. 313-320; Mar. 2005 (8 pages).
Verónica Salgueiriño-Maceira et al.; "Bifunctional Gold-Coated Magnetic Silica Spheres"; Chem. Mater.; vol. 18; No. 11; pp. 2701-2706; 2006 (6 pages).
Weibo Cai et al; "Nanoplatforms for Targeted Molecular Imaging in Living Subjects", Small; vol. 3; pp. 1840-1854, 2007 (15 pages).
Wim F. J. Vermaas et al.; "In vivo hyperspectral confocal fluorescence imaging to determine pigment localization and distribution in cyanobacterial cells"; PNAS; vol. 105; No. 10; pp. 4050-4055; Mar. 11, 2008 (6 pages).
W. Preuss et al.; "Precision machining of integral field units"; New Astronomy Reviews; vol. 50; pp. 332-336; 2006 (5 pages).
William R. Johnson et al.; "Snapshot hyperspectral imaging in ophthalmology"; Journal of Biomedical Optics; vol. 12; No. 1; pp. 014036-1 to 014036-7; Jan./Feb. 2007 (7 pages).
Written Opinion issued in Application No. PCT/US2009/063259, dated Apr. 23, 2010 (8 pages).
Written Opinion issued in Application No. PCT/US2010/060477, dated Mar. 2, 2012 (9 pages).
Written Opinion issued in Application No. PCT/US2011/021371, dated Mar. 16, 2012 (4 pages).
Written Opinion issued in Application No. PCT/US2011/060371, dated Feb. 13, 2012 (6 pages).
Written Opinion issued in Application No. PCT/US2011/062497, dated Mar. 6, 2012 (7 pages).
Written Opinion issued in Application No. PCT/US2011/062507, dated Mar. 6, 2012 (7 pages).
Written Opinion issued in Application No. PCT/US2014/016845, dated May 21, 2014 (5 pages).
Yasushi Hiraoka et al.; "Multispectral Imaging Fluorescence Microscopy for Living Cells"; Cell Structure and Function; vol. 27; pp. 367-374; 2002 (8 pages).

(56) References Cited

OTHER PUBLICATIONS

Yasuteru Urano et al.; "Selective molecular imaging of viable cancer cells with pH-activatable fluorescence probes"; Nature Medicine; vol. 15; pp. 104-109; Jan. 2009 (6 pages).
Ying Yang et al.; "Heat transfer properties of nanoparticle-in-fluid dispersions (nanofluids) in laminar flow"; International Journal of Heat and Mass Transfer; vol. 48; pp. 1107-1116; 2005 (10 pages).
International Preliminary Report on Patentability issued in Application No. PCT/US2011/060371, dated May 23, 2013 (8 pages).
International Preliminary Report on Patentability issued in Application No. PCT/US2011/062507, dated Jun. 27, 2013 (9 pages).
International Preliminary Report on Patentability issued in Application No. PCT/US2014/016845, dated Aug. 27, 2015 (7 pages).
International Search Report issued in Application No. PCT/US2011/060371, dated Feb. 13, 2012 (4 pages).
International Search Report issued in Application No. PCT/US2009/063259, dated Apr. 23, 2010 (4 pages).
International Search Report issued in Application No. PCT/US2011/021371, dated Mar. 16, 2012 (3 pages).
International Search Report issued in Application No. PCT/US2014/016845 dated May 21, 2014 (3 pages).
Jeremy Allington-Smith et al.; "New developments in Integral Field Spectroscopy"; Proc. of SPIE; vol. 3355; Optical Astronomical Instrumentation; pp. 196-205; 1998 (10 pages).
Jeremy Allington-Smith; "Basic principles of integral field spectroscopy"; New Astronomy Reviews; vol. 50; pp. 244-251; 2006 (8 pages).
J. Carlsson et al. "HER2 expression in breast cancer primary tumours and corresponding metastases. Original data and literature review"; British Journal of Cancer; vol. 90; pp. 2344-2348; 2004 (5 pages).
Jinwoo Cheon et al.; "Synergistically Integrated Nanoparticles as Multimodal Probes for Nanobiotechnology"; Accounts of Chemical Research; 2008 (11 pages).
J. G. Endriz et al.; "Surface-Plasmon-One-Electron Decay and Its Observation in Photoemission"; Physical Review Letters; vol. 24; No. 2; pp. 64-68; Jan. 12, 1970 (5 pages).
J. Hofmann et al.; "Plasma Resonance in the Photoemission of Silver"; Physica Status Solidi; vol. 30; pp. K53-K56; 1968 (4 pages).
Jorge Pérez-Juste et al.; "Review: Gold Nanorods: Synthesis, characterization and applications"; Coordination Chemistry Reviews; vol. 249; pp. 1870-1901; 2005 (32 pages).
J.Schmoll et al.; "Optical replication techniques for image slicers"; New Astronomy Reviews 50; pp. 263-266; 2006 (4 pages).
John V. Frangioni; "In vivo near-infrared fluorescence imaging"; Current Opinion Chemical Biology, 7; pp. 626-634; 2003 (9 pages).
Jae-Hyun Lee et al.; "Artificially engineered magnetic nanoparticles for ultra-sensitive molecular imaging"; Nature Medicine; vol. 13; pp. 95-99; Jan. 2007 (5 pages).
Jaeyun Kim et al.; "Designed Fabrication of Multifunctional Magnetic Gold Nanoshells and Their Application to Magnetic Resonance Imaging and Photothermal Therapy"; Angew. Chem. Int. Ed.; vol. 45; pp. 7754-7758; 2006 (5 pages).
Ji-Ho Park et al.; "Micellar Hybrid Nanoparticles for Simultaneous Magnetofluorescent Imaging and Drug Delivery"; Angew. Chem. Int. Ed.; vol. 47; pp. 7284-7288; 2008 (5 pages).
Jing Yong Ye et al.; "Whole spectrum fluorescence detection with ultrafast white light excitation"; Optics Express; vol. 15; No. 16; pp. 10439-10445; 2007 (7 pages).
JR Lacowicz; "Chapter 10: Fluorescence Anisotropy"; Principles of Fluorescence Spectroscopy, pp. 353-382; 2006 (30 pages).
Karel J. Zuzak et al., "Hyperspectral Imaging Utilizing LCTF and DLP Technology for Surgical and Clinical Applications"; Proceedings of SPIE; vol. 7170; pp. 71700C-1 to 71700C-9; 2009 (9 pages).
Karel J. Zuzak et al.; "Visible Reflectance Hyperspectral Imaging: Characterization of a Noninvasive, in Vivo System for Determining Tissue Perfusion"; Analytical Chemistry; vol. 74; No. 9; pp. 2021-2028; 2002, (8 pages).
Keith N. Richmond et al.; "Critical PO2 of skeletal muscle in vivo"; Am. J. Physiol; vol. 277; pp. H1831-H1840; 1999 (10 pages).
Ken Ritchie et al.; "Detection of Non-Brownian Diffusion in the Cell Membrane in Single Molecule Tracking"; Biophysical Journal; vol. 88, pp. 2266-2277; Mar. 2005 (12 pages).
K. Shah et al.; "Molecular imaging of gene therapy for cancer", Gene Therapy; vol. 11; pp. 1175-1187; 2004 (13 pages).
L. R. Hirsch et al.; "Nanoshell-mediated near-infrared thermal therapy of tumors under magnetic resonance guidance"; PNAS, vol. 100, No. 23, pp. 13549-13554; Nov. 11, 2003 (7 pages).
L. Weitzel et al.; "3D: The next generation near-infrared imaging spectrometer"; Astronomy & Astrophysics Supplement Series; vol. 119; pp. 531-546; 1996 (16 pages).
Liang Gao et al.; "Compact Image Slicing Spectrometer (ISS) for hyperspectral fluorescence microscopy"; Optics Express; vol. 17; No. 15; pp. 12293-12308; Jul. 20, 2009 (16 pages).
Liang Gao et al.; "Snapshot Image Mapping Spectrometer (IMS) with high sampling density for hyperspectral microscopy"; Optics Express; vol. 18; No. 14; pp. 14330-14344; 2010 (15 pages).
Michael Doubrovin et al.; "Multimodality in Vivo Molecular-Genetic Imaging"; Bioconjugate Chemistry; vol. 15; No. 6; pp. 1376-1388; 2004 (14 pages).
M. E. Gehm et al., "Single-shot compressive spectral imaging with a dual-disperser architecture"; Optics Express; vol. 15; No. 21; pp. 14013-14027; Oct. 17, 2007 (15 pages).
Moritz F. Kircher et al.; "A Multimodal Nanoparticle for Preoperative Magnetic Resonance Imaging and Intraoperative Optical Brain Tumor Delineation"; Cancer Research; vol. 63; pp. 8122-8125; 2003 (5 pages).
M.J. Booth et al.; "Full spectrum filterless fluorescence microscopy"; Journal of Microscopy; vol. 237; Pt 1; pp. 103-109; 2010 (7 pages).
Maksymilian Pluta; "Advanced Light Microscopy, vol. 1: Principles and Basic Properties"; Elsevier; pp. 349-355; 1988 (7 pages).
Matthias Tecza et al.; "SWIFT Image Slicer: large format, compact, low scatter image slicing"; Proceedings of SPIE; vol. 6273; pp. 62732L-1 to 62732L-10; 2006 (10 pages).
Mark W. Knight et al.; "Photodetection with Active Optical Antennas"; Science; vol. 332; pp. 702-704; 2011 (4 pages).
Mi-Ran Choi et al.; "A Cellular Trojan Horse for Delivery of Therapeutic Nanoparticles into Tumors"; Nano Letters, vol. 7, No. 12, pp. 3759-3765; 2007 (7 pages).
Mitsuo Fukuda et al.; "Light detection enhanced by surface plasmon resonance in metal film"; Applied Physics Letters; vol. 96; pp. 153107-1 to 153107-3; 2010 (4 pages).
Non-Final Office Action issued in related U.S. Appl. No. 13/514,762, dated Apr. 5, 2016 (26 pages).
Notice of Grounds of Rejection issued in Japanese Application No. 2011-534898, dated Apr. 2, 2013 (13 pages).
Notification of First Office Action issued in Chinese Application No. 200980151779.4, dated Mar. 28, 2013 (8 pages).
Omid Veiseh et al.; "Optical and MRI Multifunctional Nanoprobe for Targeting Gliomas"; Nano Letters; vol. 5; pp. 1003-1008; 2005 (7 pages).
Official Action issued in Israel Application No. 212613, dated Apr. 7, 2013 (7 pages).
Official Action issued in Russian Application No. 2011122642, dated Aug. 16, 2013 (14 pages).
P. B. Johnson et al.; "Optical Constants of the Noble Metals"; Physical Review B; vol. 6; No. 12; pp. 4370-4379; 1972 (10 pages).
Paul Carter et al.; "Humanization of an anti-p185HER2 antibody for human cancer therapy"; Proc. Natl. Acad. Sci. USA; vol. 89; pp. 4285-4289; May 1992 (5 pages).
Pierre Smirnov et al.; "In Vivo Cellular Imaging of Lymphocyte Trafficking by MRI: A Tumor Model Approach to Cell-Based Anticancer Therapy"; Magnetic Resonance in Medicine; vol. 56; pp. 498-508; 2006 (11 pages).
Richard A. Schwarz et al.; "Noninvasive Evaluation of Oral Lesions Using Depth-sensitive Optical Spectroscopy"; Cancer; vol. 115; pp. 1669-1679; Apr. 15, 2009 (11 pages).
Rizia Bardhan et al.; "Fluorescence Enhancement by Au Nanostructures: Nanoshells and Nanorods"; ACS Nano; vol. 3; No. 3; pp. 744-752; 2009 (10 pages).

(56) References Cited

OTHER PUBLICATIONS

Ashwin A. Wagadarikar et al.; "Video rate spectral imaging using a coded aperture snapshot spectral imager"; Optics Express; vol. 17; No. 8; pp. 6368-6388; 2009 (21 pages).
Andrew Burns et al.; "Fluorescent core-shell silica nanoparticles: towards "Lab on a Particle" architectures for nanobiotechnology"; Chemical Society Reviews; vol. 35; pp. 1028-1042; 2006 (15 pages).
Anand Gole et al.; "Iron Oxide Coated Gold Nanorods: Synthesis, Characterization, and Magnetic Manipulation"; Langmuir; vol. 24; No. 12; pp. 6232-6237; 2008 (6 pages).
Alistair Gorman et al.; "Generalization of the Lyot filter and its application to snapshot spectral imaging"; Optics Express; vol. 18; No. 6; pp. 5602-5608; Mar. 15, 2010 (7 pages).
A. M. Cowley; "Titanium-Silicon Schottky Barrier Diodes"; Solid-State Electronics; vol. 12; pp. 403-414; 1970 (12 pages).
Andre M. Gobin et al.; "EphrinA I-targeted nanoshells for photothermal ablation of prostate cancer cells"; International Journal of Nanomedicine; vol. 3; pp. 351-358; 2008 (8 pages).
André M. Gobin et al.; "Near-Infrared Resonant Nanoshells for Combined Optical Imaging and Photothermal Cancer Therapy"; Nano Letters, vol. 7, No. 7, pp. 1929-1934, 2007 (6 pages).
Amanda R. Lowery et al.; "Immunonanoshells for targeted photothermal ablation of tumor cells"; International Journal of Nanomedicine; vol. 1, No. 2; pp. 1-6; 2006 (6 pages).
Antoni Rogalski; "Review: Infrared detectors: status and trends"; Progress in Quantum Electronics; vol. 27; pp. 59-210; 2003 (152 pages).
Andrew S. Belmont; "Visualizing chromosome dynamics with GFP"; TRENDS in Cell Biology; vol. 11; No. 6; pp. 250-257; Jun. 2001 (8 pages).
Ashwin Wagadarikar et al.; "Single disperser design for coded aperture snapshot spectral imaging"; Applied Optics; vol. 47; No. 10; pp. B44-B51; Apr. 1, 2008 (8 pages).
Bridget K. Ford et al.; "Computed Tomography-Based Spectral Imaging for Fluorescence Microscopy"; Biophysical Journal; vol. 80; pp. 986-993; Feb. 2001 (8 pages).
Bridget K. Ford et al.; "Large-image-format computed tomography imaging spectrometer for fluorescence microscopy"; Optics Express; vol. 9; No. 9; pp. 444-453; Oct. 22, 2001 (10 pages).
B. P. Hills et al.; "NMR Water Relaxation, Water Activity and Bacterial Survival in Porous Media"; J. Sci. Food Agric.; vol. 71; pp. 185-194; 1996 (10 pages).
Biological Sciences Division; "Mechanisms of 3D intercellular signaling in mammary epithelial cells in response to low dose, low-LET radiation: Implications for the radiation-induced bystander effect"; Research Highlights; Nov. 2004 (2 pages).
Christy A. Fernandez et al.; "Fluorescence microscopy with a coded aperture snapshot spectral imager"; Proceedings of SPIE; vol. 7184; pp. 71840Z-1 to 71840Z-11; 2009 (11 pages).
Christophe Bonneville et al.; "Design, prototypes and performances of an image slicer system for integral field spectroscopy"; Proceedings of SPIE; vol. 4842; pp. 162-173; 2003 (12 pages).
C. Chapon et al.; "High Field Magnetic Resonance Imaging Evaluation of Superparamagnetic Iron Oxide Nanoparticles in a Permanent Rat Myocardial Infarction"; Investigative Radiology, vol. 38, No. 3; pp. 141-146; Mar. 2003 (6 pages).
Christy Fernandez Cull et al.; "Identification of fluorescent beads using a coded aperture snapshot spectral imager"; Applied Optics; vol. 49; No. 10; pp. B59-B70; Apr. 1, 2010 (12 pages).
Cornelis M. Dubbeldam et al.; "Freeform Diamond Machining of Complex Monolithic Metal Optics for Integral Field Systems"; Proceedings of SPIE; vol. 5494; pp. 163-175; 2004 (13 pages).
Cornelis M. Dubbeldam et al.; "Prototyping of Diamond Machined Optics for the KMOS and JWST NIRSpec Integral Field Units"; Proceedings of SPIE; vol. 6273; Jul. 6, 2006 (13 pages).
C. Martínez-Boubeta et al.; "Critical radius for exchange bias in naturally oxidized Fe nanoparticles"; Physical Review B; vol. 74; pp. 054430-1 to 054430-10; 2006 (10 pages).
Cuiling Ren et al.; "Synthesis of Organic Dye-Impregnated Silica Shell-Coated Iron Oxide Nanoparticles by a New Method"; Nanoscale Res Lett; vol. 3; pp. 496-501; 2008 (6 pages).
Christine Scales et al.; "Thin-Film Schottky Barrier Photodetector Models"; IEEE Journal of Quantum Electronics; vol. 46; No. 5; pp. 633-643; May 2010 (11 pages).
Cambridge Research & Instrumentation, Inc.; "VariSpec: Liquid Crystal Tunable Filters"; Product Informational Brochure, Date Unknown (2 pages).
Carl Zeiss MicroImaging GmbH; "LSM 710: The Power of Sensitivity"; Informational product brochure; date unknown (32 pages).
Carl Zeiss MicroImaging GmbH; "LSM 510 METAMk4: Progressional Excitation Laser Module—Flexibility for the Next Generation of Fluorescent Dyes"; Informational product brochure; date unknown (4 pages).
ChromoDynamics, Inc., "Hyperspectral Imaging Solutions for the Life Sciences"; Informational product brochure; date unknown (2 pages).
David G. Spiller et al.; "Measurement of single-cell dynamics"; Nature; vol. 465; pp. 736-745; Jun. 10, 2010 (10 pages).
David Landgrebe; "Information Extraction Principles and Methods for Multispectral and Hyperspectral Image Data"; Information Processing for Remote Sensing; 1998 (30 pages).
David M. Haaland et al.; "Multivariate Curve Resolution for Hyperspectral Image Analysis: Applications to Microarray Technology"; Proceedings of SPIE; vol. 4959; pp. 55-66; 2003 (12 pages).
Der Yi Hsu et al.; "Wide-range tunable Fabry-Perot array filter for wavelength-division multiplexing applications"; Applied Optics; vol. 44; No. 9; pp. 1529-1532; 2005 (4 pages).
Colin Coates et al.; "sCMOS Scientific CMOS Technology: A High-Performance Imaging Breakthrough"; White Paper—www.scmos.com; Jun. 16, 2009 (16 pages).
E. Prodan et al.; "The effect of a dielectric core and embedding medium on the polarizability of metallic nanoshells"; Chemical Physics Letters, vol. 360, pp. 325-332, Jul. 10, 2002 (8 pages).
Elena V. Shevchenko et al.; "Gold/Iron Oxide Core/Hollow-Shell Nanoparticles"; Advanced Materials; vol. 20; pp. 4323-4329, 2008 (7 pages).
F. A. Kruse; "Chapter 11: Visible-Infrared Sensors and Case Studies"; Analytical Imaging and Geophysics, Boulder, Colorado; 1999 (69 pages).
François Hénault et al.; "Slicing the Universe at affordable cost: The Quest for the MUSE Image Slicer"; Proceedings of SPIE; vol. 5249; pp. 134-145; 2004 (12 pages).
Florence Laurent et al.; "Design of an Integral Field Unit for MUSE, and Results from Prototyping"; Publications of the Astronomical Society of the Pacific; vol. 118; pp. 1564-1573; Nov. 2006 (10 pages).
Felicia Tam et al.; "Plasmonic Enhancement of Molecular Fluorescence"; Nano Letters; vol. 7; No. 2; pp. 496-501; 2007 (6 pages).
Final Office Action issued in related U.S. Appl. No. 13/326,500, dated Feb. 1, 2016 (12 pages).
Final Office Action issued in related U.S. Appl. No. 13/326,521, dated Sep. 5, 2014 (7 pages).
Final Office Action issued in related U.S. Appl. No. 13/992,898, dated Mar. 25, 2016 (10 pages).
Fong-Yu Cheng et al.; "Characterization of aqueous dispersions of Fe3O4 nanoparticles and their biomedical applications"; Biomaterials; vol. 26; pp. 729-738; 2005 (10 pages).
Giulio Gambarota et al.; "Assessment of absolute blood volume in carcinoma by USPIO contrast-enhanced MRI"; Magnetic Resonance Imaging; vol. 24; pp. 279-286; 2006 (8 pages).
George H. Patterson et al.; "Photobleaching in Two-Photon Excitation Microscopy"; Biophysical Journal; vol. 78; pp. 2159-2162; Apr. 2000 (4 pages).
H. E. Bennett et al.; "Infrared Reflectance of Evaporated Aluminum Films"; Journal of the Optical Society of America; vol. 52; No. 11; pp. 1245-1250; Nov. 1962 (6 pages).
Harrison H. Barrett; "Diffraction Theory and Imaging"; Foundations of Image Science; pp. 457-550; 2004 (95 pages).

(56) References Cited

OTHER PUBLICATIONS

Hideaki Matsuoka et al.; "Single-cell viability assessment with a novel spectro-imaging system"; Journal of Biotechnology; vol. 94; pp. 299-308; 2002 (10 pages).
International Preliminary Report on Patentability issued in Application No. PCT/US2009/063259, dated May 19, 2011 (10 pages).
International Preliminary Report on Patentability issued in Application No. PCT/US2011/021371, dated Jul. 25, 2013 (6 pages).
Young Soo Kang et al.; "Synthesis and Characterization of Nanometer-Size Fe3O4 and y-Fe2O3 Particles"; Chem. Mater.; vol. 8; No. 9; pp. 2209-2211; 1996 (3 pages).
Z. M. Tovbina et al.; "Study of the Proton Relaxation Times of Water in the Pores of Silica Gels Having Different Structures"; Teoreticheskaya i Eksperimental'naya Khimiya; vol. 5; No. 6; pp. 619-621; 1969 (3 pages).
Z. Malik et al.; "Fourier transform multipixel spectroscopy for quantitative cytology"; Journal of Microscopy; vol. 182; Pt 2; pp. 133-140; May 1996 (8 pages).
Rayavarapu RG, Petersen W, Hartsuiker L, Chin P, Janssen H, van Leeuwen FW, Otto C, Manohar S, van Leeuwen TG, "In vitro toxicity studies of polymercoated gold nanorods" Apr. 9, 2010, "Nanotechnology", 21 (14).
Todd Otanicar, P. E. Phelan, R. S. Prasher, G. Rosengarten, R. A. Taylor "Nanofluid-Based Direct Absorption Solar Collector", May 26, 2010.
Yun-Sheng Chen, Wolfgang Frey, Seungsoo Kim, Kimberly Homan, Pieter Kruizinga, Konstantin Sokolov, and Stanislav Emelianov, "Enhanced thermal stability of silica-coated gold nanorods for photoacoustic imaging and image-guided therapy", Apr. 13, 2010, vol. 18, No. 9, Optics Express.
Office Action issued in related U.S. Appl. No. 13/884,552 dated Dec. 18, 2014 (16 pages).

* cited by examiner

GENERATING A HEATED FLUID USING AN ELECTROMAGNETIC RADIATION-ABSORBING COMPLEX

CROSS REFERENCE TO RELATED APPLICATIONS

This application claims priority under 35 U.S.C. §119(e) to U.S. Provisional Patent Application Ser. No. 61/423,278, which is incorporated by reference in its entirety.

STATEMENT REGARDING FEDERALLY SPONSORED RESEARCH OR DEVELOPMENT

The invention made with government support under Grant Number DE-AC52-06NA25396 awarded by the Department of Energy. The government has certain rights in the invention.

BACKGROUND

The process of heating a fluid involves applying energy (e.g., heat) to the fluid. To maintain fluid, however, the temperature at which the fluid is heated must be below the boiling point for such fluid. Otherwise, the fluid will transform into a vapor. Applying energy to fluid may occur in a number of ways. For example, a fluid may be placed in a container that sits over a fire or other source of heat. As another example, a fluid may be placed in a black-colored container, which is placed in the sun on a hot day. As a further example, one or more mirrors may be positioned in such a way as to direct sunlight to a container holding a fluid.

SUMMARY

In general, in one aspect, the invention relates to a vessel, comprising a concentrator configured to concentrate electromagnetic (EM) radiation received from an EM radiation source, and a complex configured to absorb EM radiation to generate heat, wherein the vessel is configured to receive a cool fluid from the cool fluid source, concentrate the EM radiation using the concentrator, apply the EM radiation to the complex, and transform, using the heat generated by the complex, the cool fluid to the heated fluid, wherein the complex is at least one selected from a group consisting of copper nanoparticles, copper oxide nanoparticles, nanoshells, nanorods, carbon moieties, encapsulated nanoshells, encapsulated nanoparticles, and branched nanostructures, wherein the EM radiation comprises at least one selected from a group consisting of EM radiation in an ultraviolet region of an electromagnetic spectrum, in a visible region of the electromagnetic spectrum, and in an infrared region of the electromagnetic spectrum.

In general, in one aspect, the invention relates to a system for supplying heated water to a water appliance, the system comprising a vessel comprising a complex, wherein the complex is at least one selected from a group consisting of copper nanoparticles, copper oxide nanoparticles, nanoshells, nanorods, carbon moieties, encapsulated nanoshells, encapsulated nanoparticles, and branched nanostructures, and wherein the vessel is configured to receive source water from a water source, concentrate electromagnetic (EM) radiation received from an EM radiation source, apply the EM radiation to the complex, wherein the complex absorbs the EM radiation to generate heat, and heat, using the heat generated by the complex, the source water in the vessel to obtain the heated water, and a tankless water heater configured to receive a signal to provide hot water to the water appliance retrieve, in response the signal, the heated water from vessel, and send the heated water to the water appliance.

In general, in one aspect, the invention relates to a system to generate a heated fluid, the system comprising a heating vessel abutting the holding tank, wherein the heating vessel comprises a complex wherein the complex is at least one selected from a group consisting of copper nanoparticles, copper oxide nanoparticles, nanoshells, nanorods, carbon moieties, encapsulated nanoshells, encapsulated nanoparticles, and branched nanostructures, and wherein the heating vessel is configured to concentrate electromagnetic (EM) radiation received from an EM radiation source, apply the EM radiation to the complex, wherein the complex absorbs the EM radiation to generate heat, provide the heat generated by the complex to a holding tank, the holding tank adapted to receive the target fluid from a fluid source and to receive the heat generated by the complex from the heating fluid vessel, wherein heat from the heating vessel heats the target fluid, a hot water storage container configured to receive the heated fluid from the holding tank and store the heated fluid.

Other aspects of the invention will be apparent from the following description and the appended claims.

DETAILED DESCRIPTION

Figure 1:
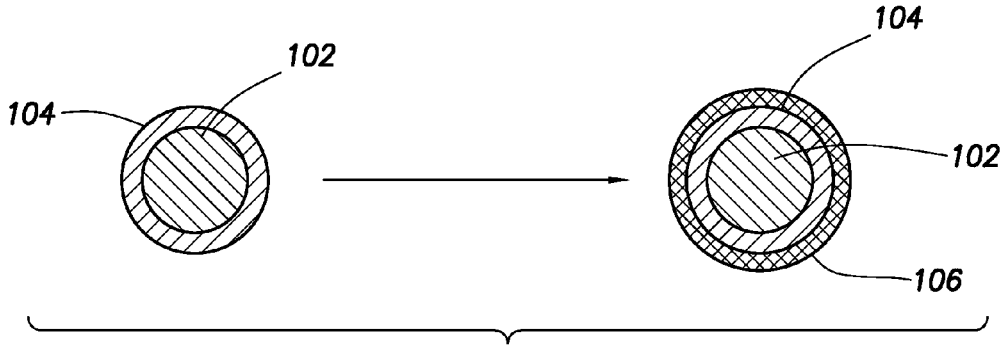
FIG. 1 shows a schematic of a complex in accordance with one or more embodiments of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention provide for generating a heated fluid using an electromagnetic (EM) radiation-absorbing complex. More specifically, one or more embodiments of the invention provide for adding energy (e.g., heat) to a cool fluid (i.e., a fluid that has a lower temperature than a desired temperature of the fluid) in order to create a heated fluid (i.e., a fluid that has a temperature substantially similar to a desired temperature of the fluid). Embodiments of the invention use complexes (e.g., nanoshells) that have absorbed EM radiation to produce the energy used to generate the heated fluid. The invention may provide for a complex mixed in a liquid solution, used to coat a wall of a vessel, integrated with a material of which a vessel is made, and/or otherwise suitably integrated with a vessel used to apply EM radiation to the complex. All the piping and associated fittings, pumps, valves, gauges, and other equipment described, used, or contemplated herein, either actually or as one of ordinary skill in the art would conceive, are made of materials resistant to the heat and/or fluid and/or vapor transported, transformed, pressurized, created, or otherwise handled within those materials.

A source of EM radiation may be any source capable of emitting energy at one or more wavelengths. For example, EM radiation may be any source that emits radiation in the ultraviolet, visible, and infrared regions of the electromagnetic spectrum. A source of EM radiation may be manmade or occur naturally. Examples of a source of EM radiation may include, but are not limited to, the sun, waste heat from an industrial process, and a light bulb. One or more concentrators may be used to intensify and/or concentrate the energy emitted by a source of EM radiation. Examples of a concentrator include, but are not limited to, lens(es), a parabolic trough(s), mirror(s), black paint, or any combination thereof.

Embodiments of this invention may be used in any residential, commercial, and/or industrial application where heating of a fluid may be needed. Examples of such applications include, but are not limited to, dishwashing, cooking, municipal services, chemical treatment, processing and manufacturing for a number of market sectors (e.g., food processing and packaging, pulp and paper, printing, chemicals and allied products, rubber, plastics, cosmetics, textile production, electronics), hospitals, universities, laboratories, drug manufacturing, wastewater and sewage treatment, and beverages. While one application for embodiments of this invention may involve heating water, other fluids aside from water may also be heated using embodiments of this invention.

In one or more embodiments, the complex may include one or more nanoparticle structures including, but not limited to, nanoshells, coated nanoshells, metal colloids, nanorods, branched or coral structures, and/or carbon moieties. In one or more embodiments, the complex may include a mixture of nanoparticle structures to absorb EM radiation. Specifically, the complex may be designed to maximize the absorption of the electromagnetic radiation emitted from the sun. Further, each complex may absorb EM radiation over a specific range of wavelengths.

In one or more embodiments, the complex may include metal nanoshells. A nanoshell is a substantially spherical dielectric core surrounded by a thin metallic shell. The plasmon resonance of a nanoshell may be determined by the size of the core relative to the thickness of the metallic shell. Nanoshells may be fabricated according to U.S. Pat. No. 6,685,986, hereby incorporated by reference in its entirety. The relative size of the dielectric core and metallic shell, as well as the optical properties of the core, shell, and medium, determines the plasmon resonance of a nanoshell. Accordingly, the overall size of the nanoshell is dependent on the absorption wavelength desired. Metal nanoshells may be designed to absorb or scatter light throughout the visible and infrared regions of the electromagnetic spectrum. For example, a plasmon resonance in the near infrared region of the spectrum (700 nm-900 nm) may have a substantially spherical silica core having a diameter between 90 nm-175 nm and a gold metallic layer between 4 nm-35 nm.

A complex may also include other core-shell structures, for example, a metallic core with one or more dielectric and/or metallic layers using the same or different metals. For example, a complex may include a gold or silver nanoparticle, spherical or rod-like, coated with a dielectric layer and further coated with another gold or silver layer. A complex may also include other core-shell structures, for example hollow metallic shell nanoparticles and/or multi-layer shells.

In one or more embodiments, a complex may include a nanoshell encapsulated with a dielectric or rare earth element oxide. For example, gold nanoshells may be coated with an additional shell layer made from silica, titanium or europium oxide.

In one embodiment of the invention, the complexes may be aggregated or otherwise combined to create aggregates. In such cases, the resulting aggregates may include complexes of the same type or complexes of different types.

In one embodiment of the invention, complexes of different types may be combined as aggregates, in solution, or embedded on substrate. By combining various types of complexes, a broad range of the EM spectrum may be absorbed.

FIG. 1 is a schematic of a nanoshell coated with an additional rare earth element oxide in accordance with one or more embodiments of the invention. Typically, a gold nanoshell has a silica core 102 surrounded by a thin gold layer 104. As stated previously, the size of the gold layer is relative to the size of the core and determines the plasmon resonance of the particle. According to one or more embodiments of the invention, a nanoshell may then be coated with a dielectric or rare earth layer 106. The additional layer 106 may serve to preserve the resultant plasmon resonance and protect the particle from any temperature effects, for example, melting of the gold layer 104.

Figure 2:
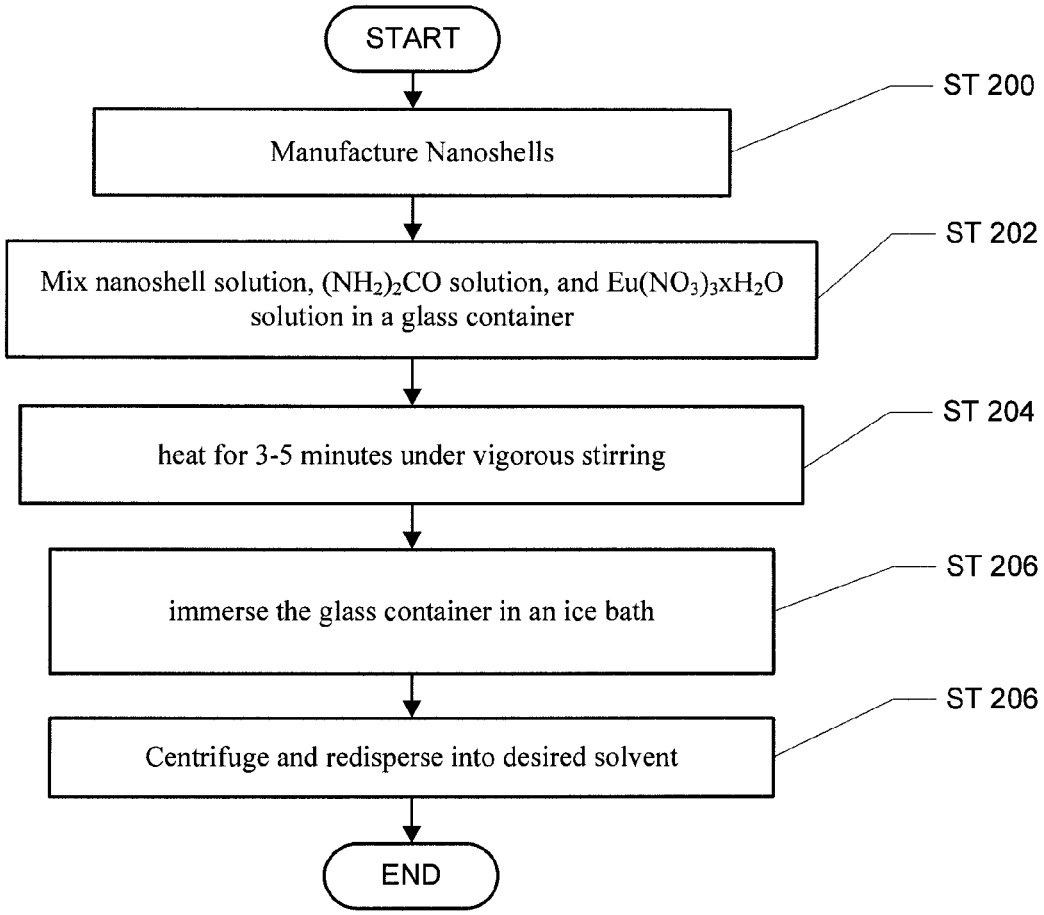
FIG. 2 shows a flow chart in accordance with one or more embodiments of the invention.

FIG. 2 is a flow chart of a method of manufacturing the coated nanoshells in accordance with one or more embodiments of the invention. In ST 200, nanoshells are manufactured according to known techniques. In the example of europium oxide, in ST 202, 20 mL of a nanoshell solution may be mixed with 10 mL of 2.5M $(NH_2)_2CO$ and 20 mL of 0.1M of $Eu(NO_3)_3xH_2O$ solutions in a glass container. In ST 204, the mixture may be heated to boiling for 3-5 minutes under vigorous stirring. The time the mixture is heated may determine the thickness of the additional layer, and may also determine the number of nanoparticle aggregates in solution. The formation of nanostructure aggregates is known to create additional plasmon resonances at wavelengths higher than the individual nanostructure that may contribute to the energy absorbed by the nanostructure for heat generation. In ST 206, the reaction may then be stopped by immersing the glass container in an ice bath. In ST 208, the solution may then be cleaned by centrifugation, and then redispersed into the desired solvent. The additional layer may contribute to the solubility of the nanoparticles in different solvents. Solvents that may be used in one or more embodiments of the invention include, but are not limited to, water, ammonia, ethylene glycol, and glycerin.

In addition to europium, other examples of element oxides that may be used in the above recipe include, but are not limited to, erbium, samarium, praseodymium, and dysprosium. The additional layer is not limited to rare earth oxides. Any coating of the particle that may result in a higher melting point, better solubility in a particular solvent, better deposition onto a particular substrate, and/or control over the number of aggregates or plasmon resonance of the particle may be used. Examples of the other coatings that may be used, but are not limited to silica, titanium dioxide, polymer-based coatings, additional layers formed by metals or metal alloys, and/or combinations of materials.

Figure 3:
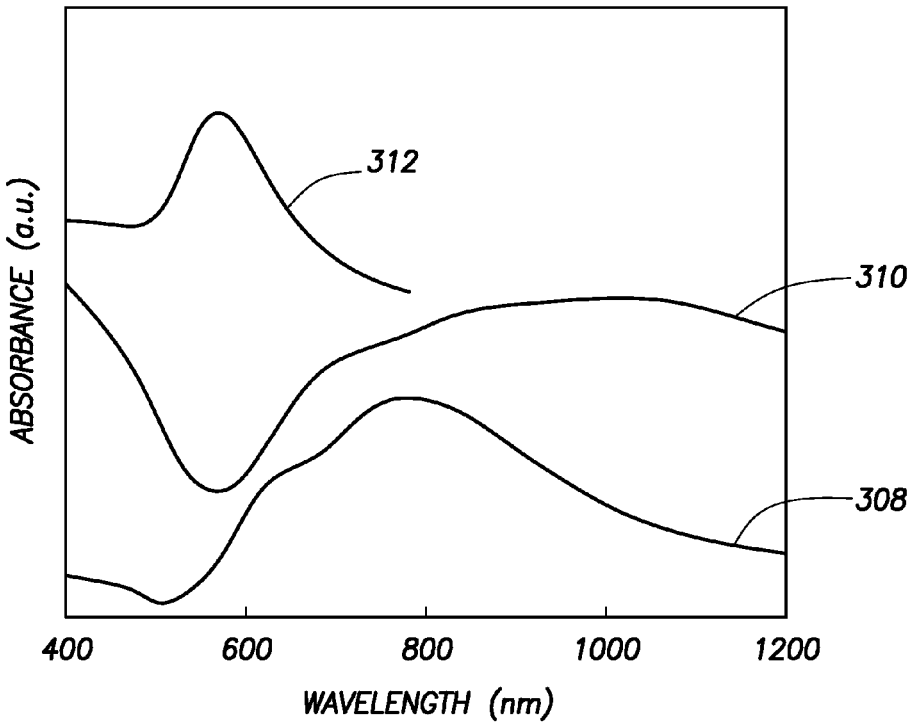
FIG. 3 shows a chart of the absorbance in accordance with one or more embodiments of the invention.

FIG. 3 is an absorbance spectrum of three nanoparticle structures that may be included in a complex in accordance with one or more embodiments disclosed herein. In FIG. 3, a gold nanoshell spectrum 308 may be engineered by selecting the core and shell dimensions to obtain a plasmon resonance peak at ~800 nm. FIG. 3 also includes a $Eu_2O_3$-encapsulated gold nanoshell spectrum 310, where the $Eu_2O_3$-encapsulated gold nanoshell is manufactured using the same nanoshells from the nanoshell spectrum 308. As may be seen in FIG. 3, there may be some particle aggregation in the addition of the europium oxide layer. However, the degree of particle aggregation may be controlled by varying the reaction time described above. FIG. 3 also includes a ~100 nm diameter spherical gold colloid spectrum 312 that may be used to absorb electromagnetic radiation in a different region of the electromagnetic spectrum. In the specific examples of FIG. 3, the $Eu_2O_3$-encapsulated gold nanoshells may be mixed with the gold colloids to construct a complex that absorbs any EM radiation from 500 nm to greater than 1200 nm. The concentrations of the different nanoparticle structures may be manipulated to achieve the desired absorption of the complex.

Figure 4A:
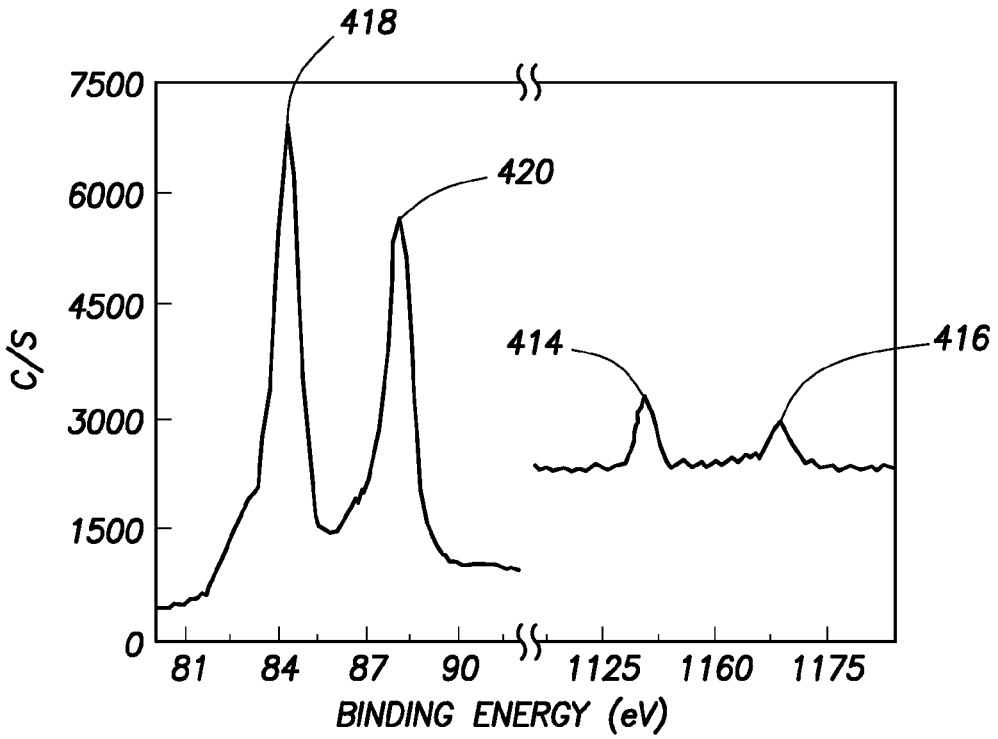
FIGS. 4A-4B show charts of an energy dispersive x-ray spectroscopy (EDS) measurement in accordance with one or more embodiments of the invention.
Figure 4B:
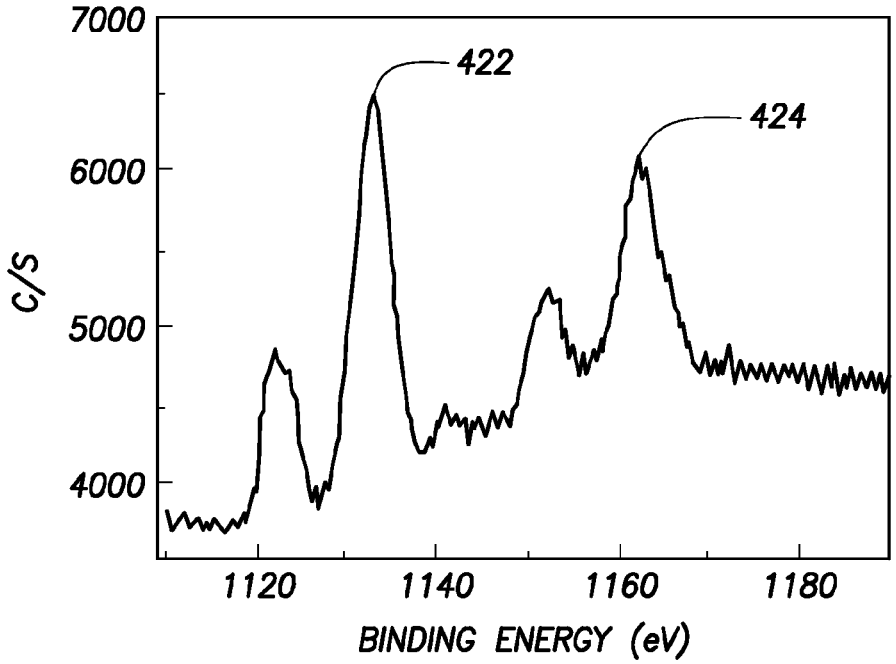

X-ray photoelectron spectroscopy (XPS) and/or energy dispersive x-ray spectroscopy (EDS) measurements may be used to investigate the chemical composition and purity of the nanoparticle structures in the complex. For example, FIG. 4A shows an XPS spectrum in accordance with one or more embodiments of the invention. XPS measurements were acquired with a PHI Quantera X-ray photoelectron spectrometer. FIG. 4A shows the XPS spectra in different spectral regions corresponding to the elements of the nanoshell encapsulated with europium oxide. FIG. 4A shows the XPS spectra display the binding energies for Eu (3d 5/2) at 1130 eV 414, Eu (2d 3/2) at 1160 eV 416, Au (4f 7/2) at 83.6 eV 418, and Au (4f 5/2) at 87.3 eV 420 of nanoshells encapsulated with europium oxide. For comparison, FIG. 4B shows an XPS spectrum of europium oxide colloids that may be manufactured according to methods known in the art. FIG. 4B shows the XPS spectra display the binding energies for Eu (3d 5/2) at 1130 eV 422 and Eu (2d 3/2) at 1160 eV 424 of europium oxide colloids.

In one or more embodiments of the invention, the complex may include solid metallic nanoparticles encapsulated with an additional layer as described above. For example, using the methods described above, solid metallic nanoparticles may be encapsulated using silica, titanium, europium, erbium, samarium, praseodymium, and dysprosium. Examples of solid metallic nanoparticles include, but are not limited to, spherical gold, silver, copper, or nickel nanoparticles or solid metallic nanorods. The specific metal may be chosen based on the plasmon resonance, or absorption, of the nanoparticle when encapsulated. The encapsulating elements may be chosen based on chemical compatibility, the encapsulating elements ability to increase the melting point of the encapsulated nanoparticle structure, and the collective plasmon resonance, or absorption, of a solution of the encapsulated nanostructure, or the plasmon resonance of the collection of encapsulated nanostructures when deposited on a substrate.

Figure 5:
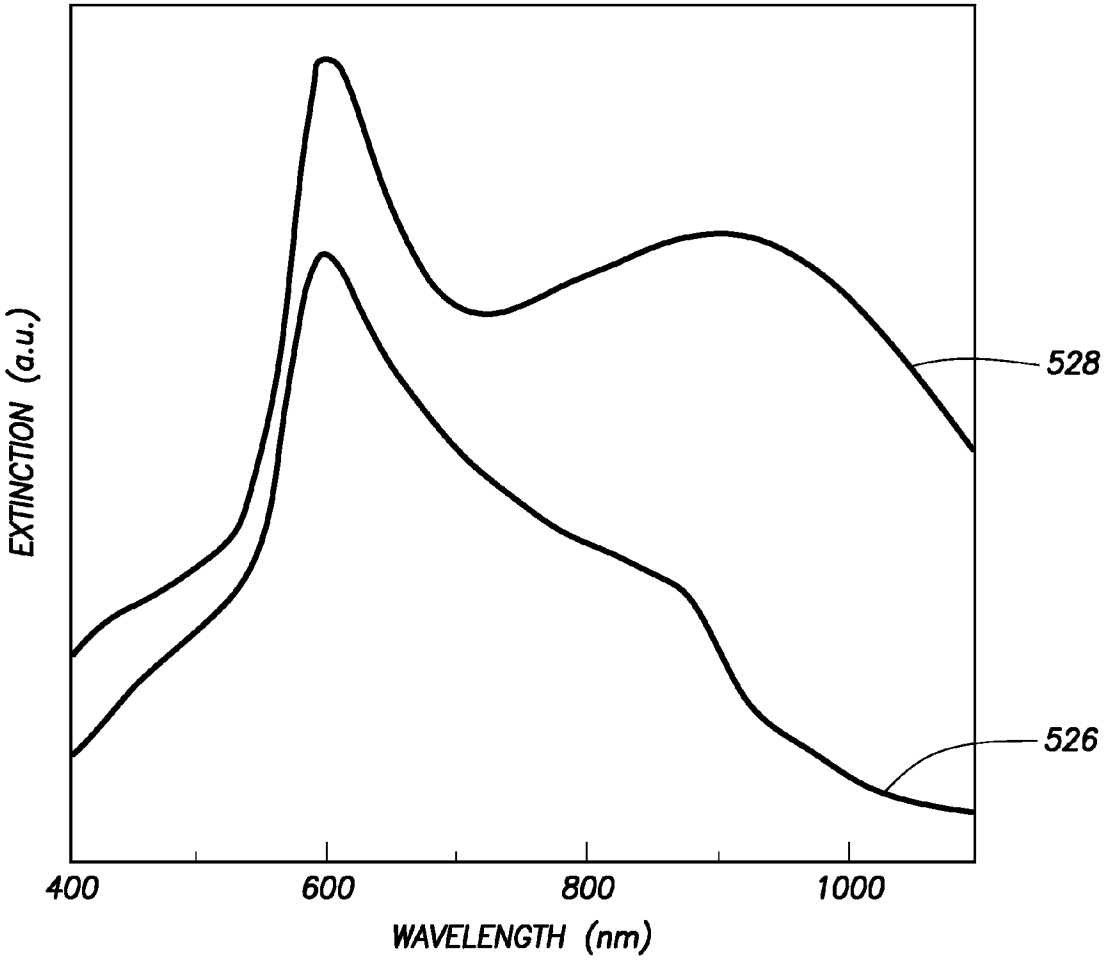
FIG. 5 shows a chart of the absorbance in accordance with one or more embodiments of the invention.

In one or more embodiments, the complex may also include copper colloids. Copper colloids may be synthesized using a solution-phase chemical reduction method. For example, 50 mL of 0.4 M aqueous solution of L-ascorbic acid, 0.8M of Polyvinyl pyridine (PVP), and 0.01M of copper (II) nitride may be mixed and heated to 70 degree Celsius until the solution color changes from a blue-green color to a red color. The color change indicates the formation of copper nanoparticles. FIG. 5 is an experimental and theoretical spectrum in accordance with one or more embodiments of the invention. FIG. 5 includes an experimental absorption spectrum 526 of copper colloids in accordance with one or more embodiments of the invention. Therefore, copper colloids may be used to absorb electromagnetic radiation in the 550 nm to 900 nm range.

FIG. 5 also includes a theoretical absorption spectrum 528 calculated using Mie scattering theory. In one or more embodiments, Mie scattering theory may be used to theoretically determine the absorbance of one or more nanoparticle structures to calculate and predict the overall absorbance of the complex. Thus, the complex may be designed to maximize the absorbance of solar electromagnetic radiation.

Figure 6:
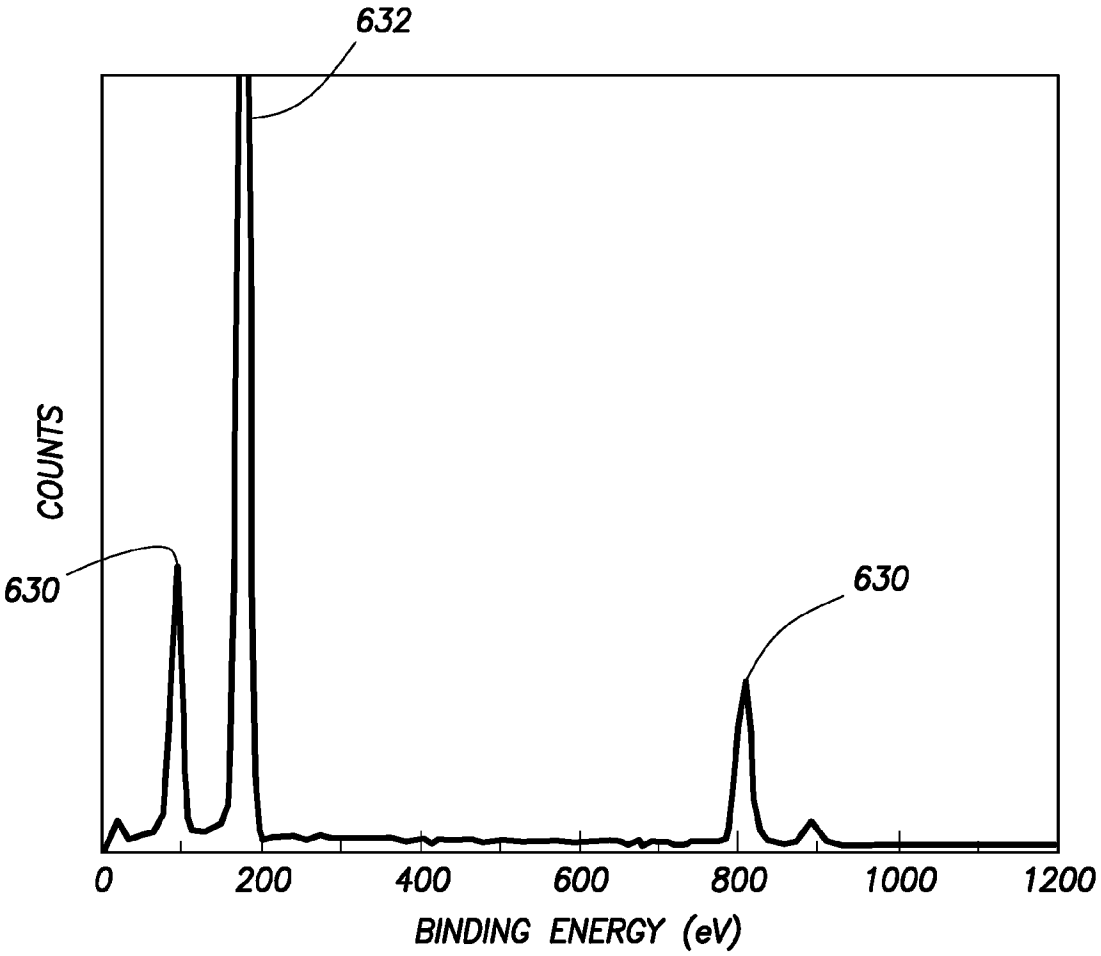
FIG. 6 shows a chart of an EDS measurement in accordance with one or more embodiments of the invention.

Referring to FIG. 6, an EDS spectrum of copper colloids in accordance with one or more embodiments of the invention is shown. The EDS spectrum of the copper colloids confirms the existence of copper atoms by the appearance peaks 630. During the EDS measurements, the particles are deposited on a silicon substrate, as evidenced by the presence of the silicon peak 632.

Figure 7:
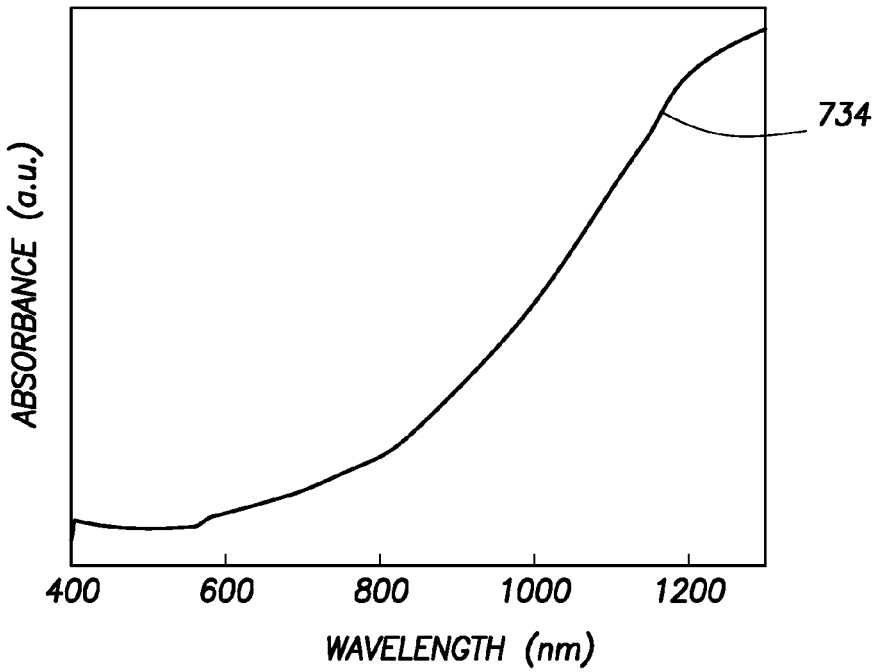
FIG. 7 shows a chart of the absorbance in accordance with one or more embodiments of the invention.

In one or more embodiments, the complex may include copper oxide nanoparticles. Copper oxide nanostructures may be synthesized by 20 mL aqueous solution of 62.5 mM $Cu(NO_3)_2$ being directly mixed with 12 mL $NH_4OH$ under stirring. The mixture may be stirred vigorously at approximately 80° C. for 3 hours, then the temperature is reduced to 40° C. and the solution is stirred overnight. The solution color turns from blue to black color indicating the formation of the copper oxide nanostructure. The copper oxide nanostructures may then be washed and resuspended in water via centrifugation. FIG. 7 shows the absorption of copper oxide nanoparticles in accordance with one or more embodiments of the invention. The absorption of the copper oxide nanoparticles 734 may be used to absorb electromagnetic radiation in the region from ~900 nm to beyond 1200 nm.

Figure 8:
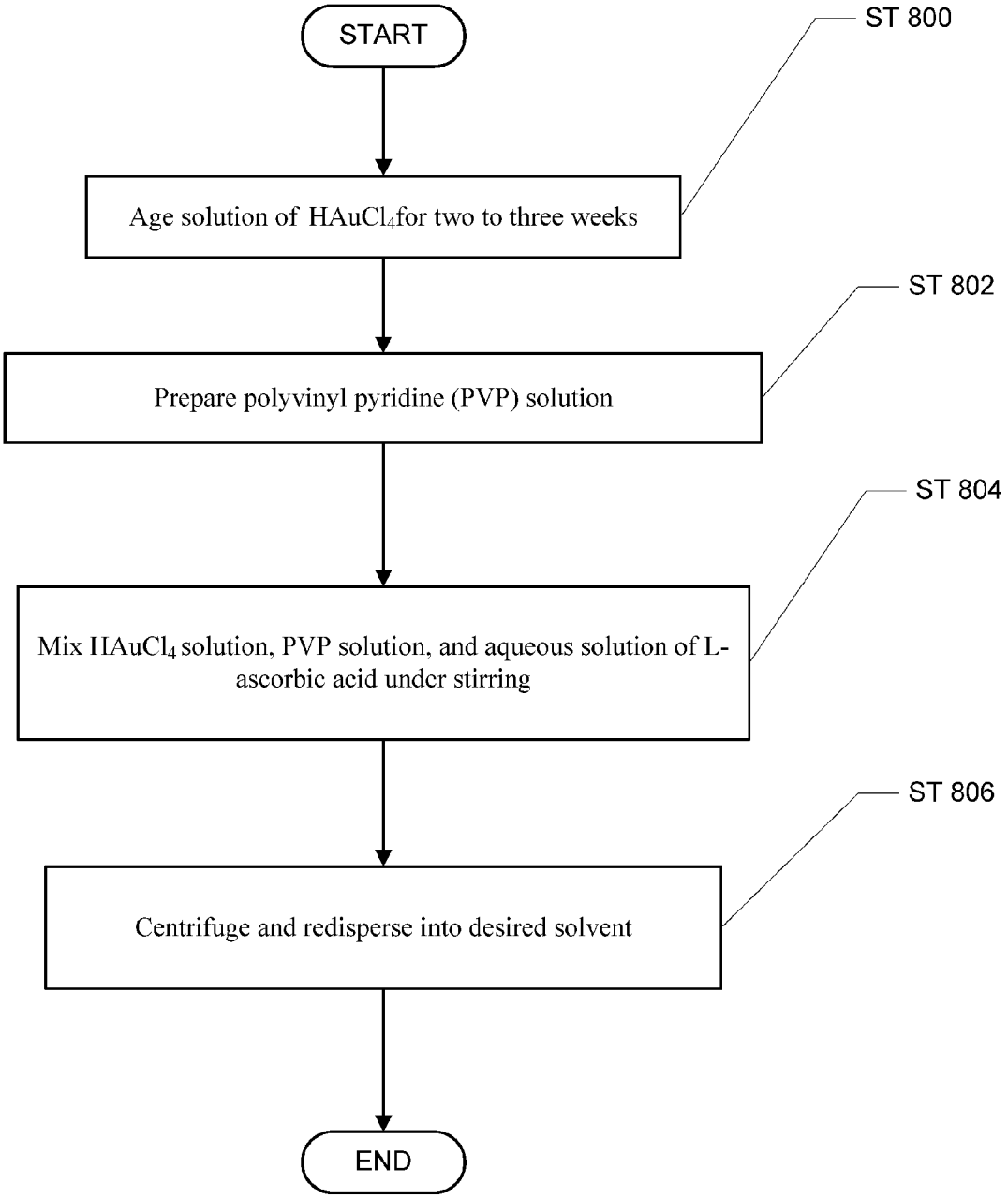
FIG. 8 shows a flow chart in accordance with one or more embodiments of the invention.

In one or more embodiments of the invention, the complex may include branched nanostructures. One of ordinary skill in the art will appreciate that embodiments of the invention are not limited to strict gold branched structures. For example, silver, nickel, copper, or platinum branched structures may also be used. FIG. 8 is a flow chart of the method of manufacturing gold branched structures in accordance with one or more embodiments of the invention. In ST 800, an aqueous solution of 1% $HAuCl_4$ may be aged for two-three weeks. In ST 802, a polyvinyl pyridine (PVP) solution may be prepared by dissolving 0.25 g in approximately 20 mL ethanol solution and rescaled with water to a final volume of 50 mL In ST 804, 50 mL of the 1% $HAuCl_4$ and 50 mL of the PVP solution may be directly mixed with 50 mL aqueous solution of 0.4M L-ascorbic acid under stirring. The solution color may turn immediately in dark blue-black color which indicates the formation of a gold nanoflower or nano-coral. Then, in ST 806, the Au nanostructures may then be washed and resuspended in water via centrifugation. In other words, the gold branched nanostructures may be synthesized through L-ascorbic acid reduction of aqueous chloroaurate ions at room temperature with addition of PVP as the capping agent. The capping polymer PVP may stabilize the gold branched nanostructures by preventing them from aggregating. In addition, the gold branched nanostructures may form a porous polymer-type matrix.

Figure 9:
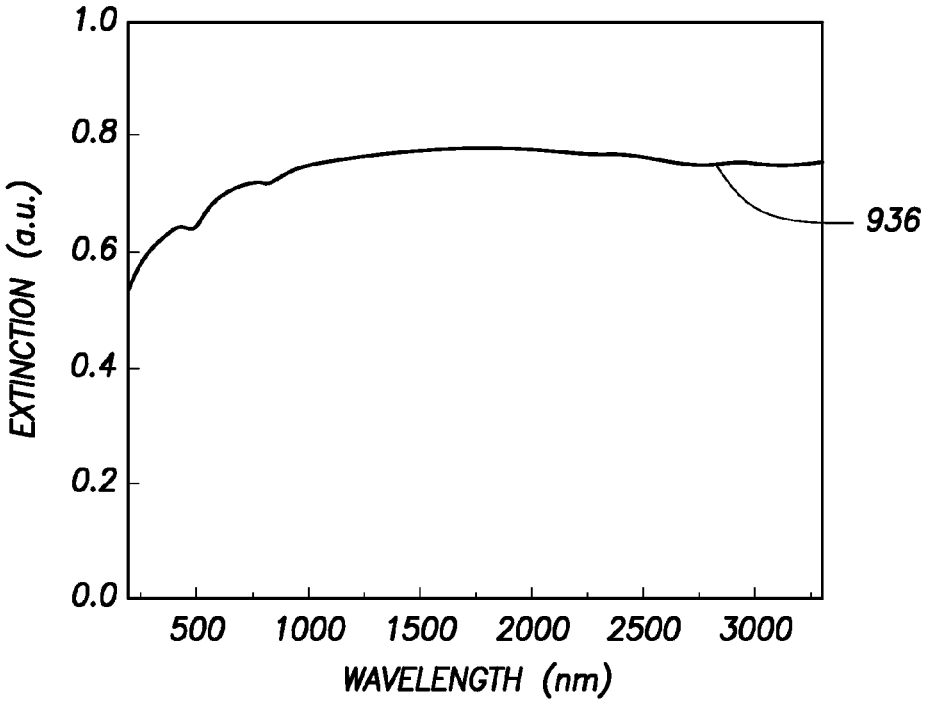
FIG. 9 shows a chart of the absorbance in accordance with one or more embodiments of the invention.

FIG. 9 shows the absorption of a solution of gold branched nanostructures in accordance with one or more embodiments of the invention. As can be seen in FIG. 9, the absorption spectrum 936 of the gold branched nanostructures is almost flat for a large spectral range, which may lead to considerably high photon absorption. The breadth of the spectrum 936 of the gold branched nanostructures may be due to the structural diversity of the gold branched nanostructures or, in other works, the collective effects of which may come as an average of individual branches of the gold branched/corals nanostructure.

Figure 10:
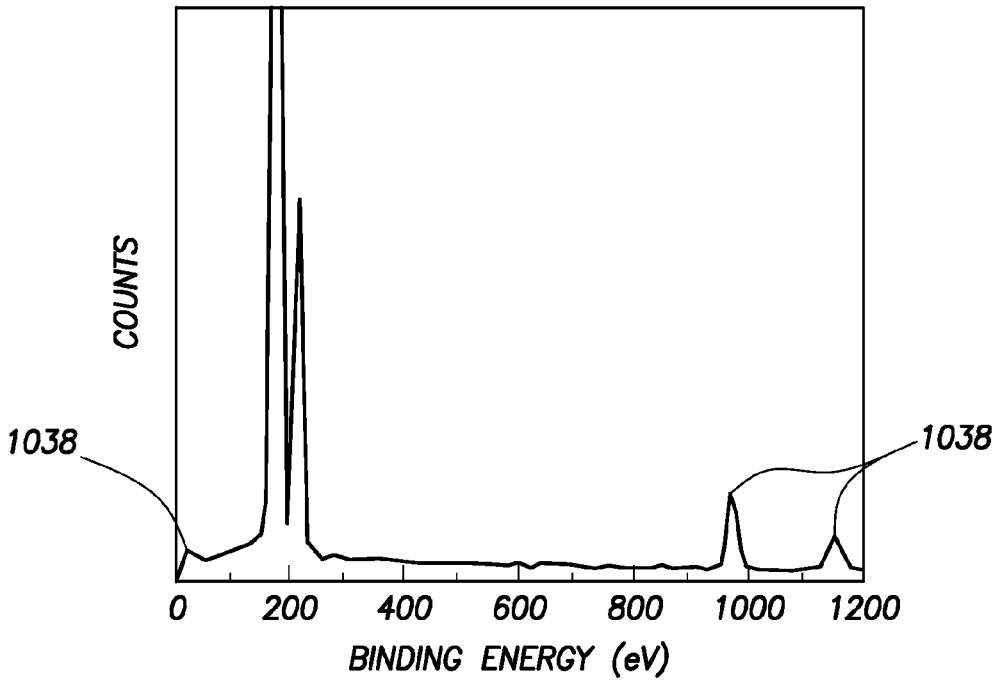
FIG. 10 shows a chart of an EDS measurement in accordance with one or more embodiments of the invention.

FIG. 10 shows the EDS measurements of the gold branched nanostructures in accordance with one or more embodiments of the invention. The EDS measurements may be performed to investigate the chemical composition and purity of the gold branched nanostructures. In addition, the peaks 1038 in the EDS measurements of gold branched nanostructures confirm the presence of Au atoms in the gold branched nano structures.

Figure 11A:
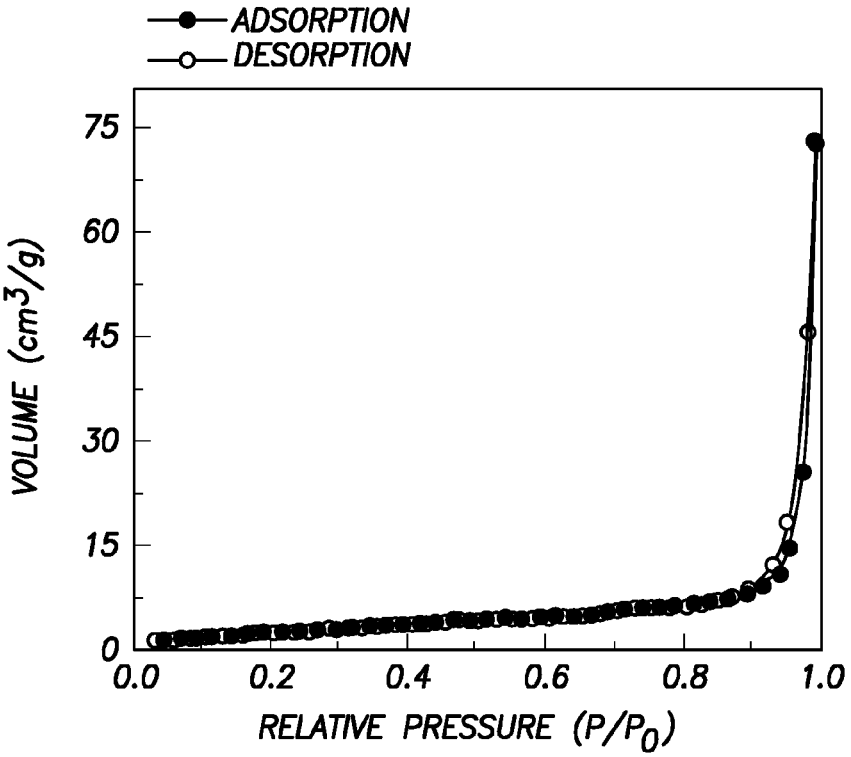
FIGS. 11A-11C show charts of the porosity of gold corral structures in accordance with one or more embodiments of the invention.
Figure 11B:
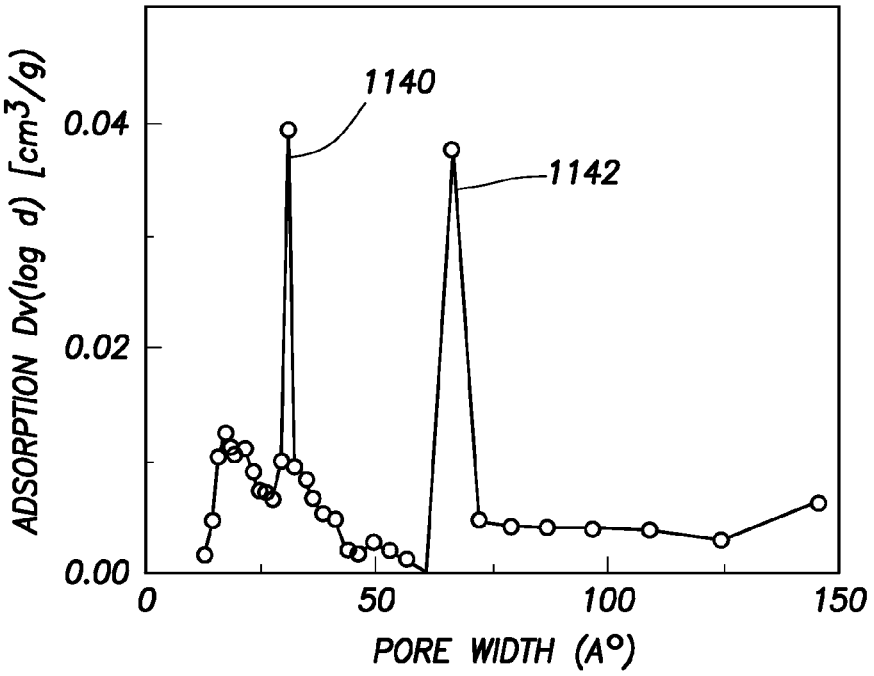
Figure 11C:
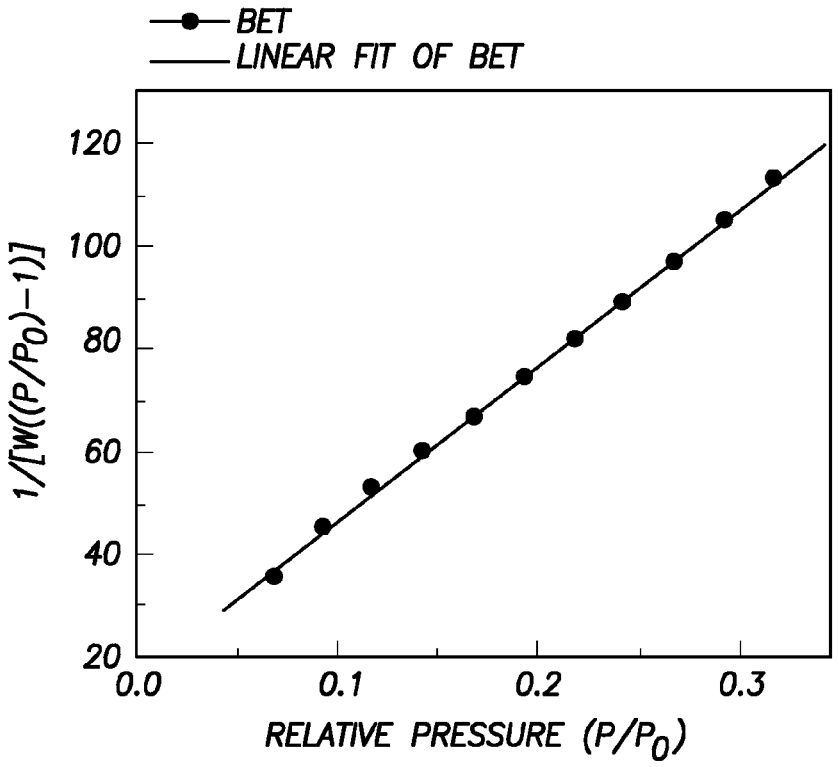

FIG. 11 shows a Brunauer-Emmett-Teller (BET) surface area and pore size distribution analysis of branches in accordance with one or more embodiments of the invention. The BET surface area and pore size may be performed to characterize the branched nanostructures. FIG. 11A presents the nitrogen adsorption-desorption isotherms of a gold corral sample calcinated at 150° C. for 8 hours. The isotherms may exhibit a type IV isotherm with a $N_2$ hysteresis loops in desorption branch as shown. As shown in FIG. 11A, the isotherms may be relatively flat in the low-pressure region ($P/P_0<0.7$). Also, the adsorption and desorption isotherms may be completely superposed, a fact which may demonstrate that the adsorption of the samples mostly likely occurs in the pores. At the relative high pressure region, the isotherms may form a loop due to the capillarity agglomeration phenomena. FIG. 11B presents a bimodal pore size distribution, showing the first peak 1140 at the pore diameter of 2.9 nm and the second peak 1142 at 6.5 nm. FIG. 11C shows the BET plots of gold branched nanostructures in accordance with one or more embodiments of the invention. A value of 10.84 $m^2/g$ was calculated for the specific surface area of branches in this example by using a multipoint BET-equation.

In one or more embodiments of the invention, the gold branched nanostructures dispersed in water may increase the nucleation sites for boiling, absorb electromagnetic energy, decrease the bubble lifetime due to high surface temperature and high porosity, and increase the interfacial turbulence by the water gradient temperature and the Brownian motion of the particles. The efficiency of a gold branched complex solution may be high because it may allow the entire fluid to be involved in the boiling process.

As demonstrated in the above figures and text, in accordance with one or more embodiments of the invention, the complex may include a number of different specific nanostructures chosen to maximize the absorption of the complex in a desired region of the electromagnetic spectrum. In addition, the complex may be suspended in different solvents, for example water or ethylene glycol. Also, the complex may be deposited onto a surface according to known techniques. For example, a molecular or polymer linker may be used to fix the complex to a surface, while allowing a solvent to be heated when exposed to the complex. The complex may also be embedded in a matrix or porous material. For example, the complex may be embedded in a polymer or porous matrix material formed to be inserted into a particular embodiment as described below. For example, the complex could be formed into a removable cartridge. As another example, a porous medium (e.g., fiberglass) may be embedded with the complex and placed in the interior of a vessel containing a fluid to be heated. The complex may also be formed into shapes in one or more embodiments described below in order to maximize the surface of the complex and, thus, maximize the absorption of EM radiation. In addition, the complex may be embedded in a packed column or coated onto rods inserted into one or more embodiments described below.

Figure 12A:
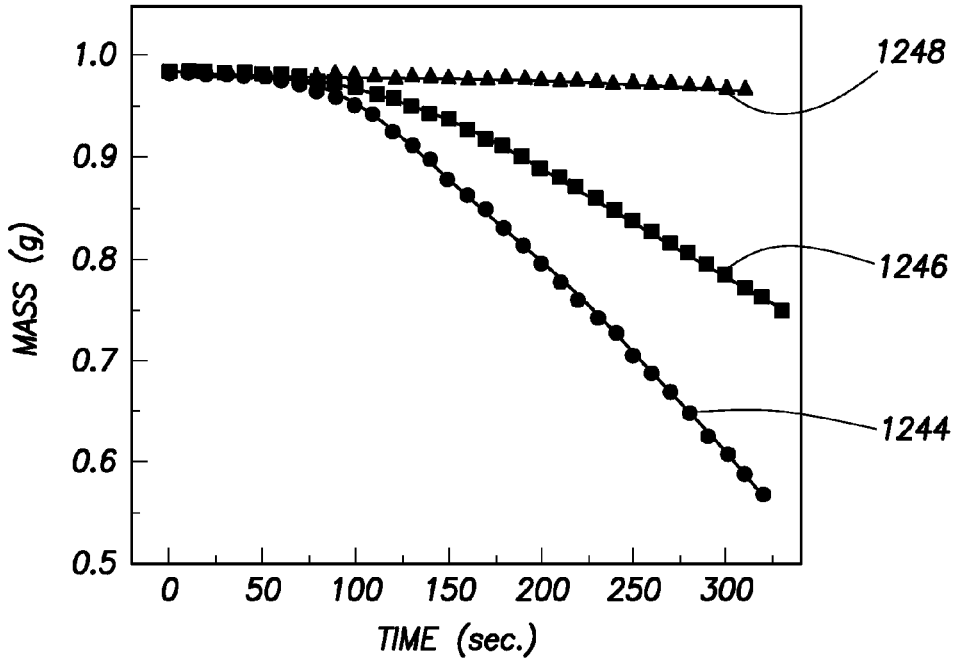
FIGS. 12A-12C show charts of the mass loss of water into steam in accordance with one or more embodiments of the invention.
Figure 12B:
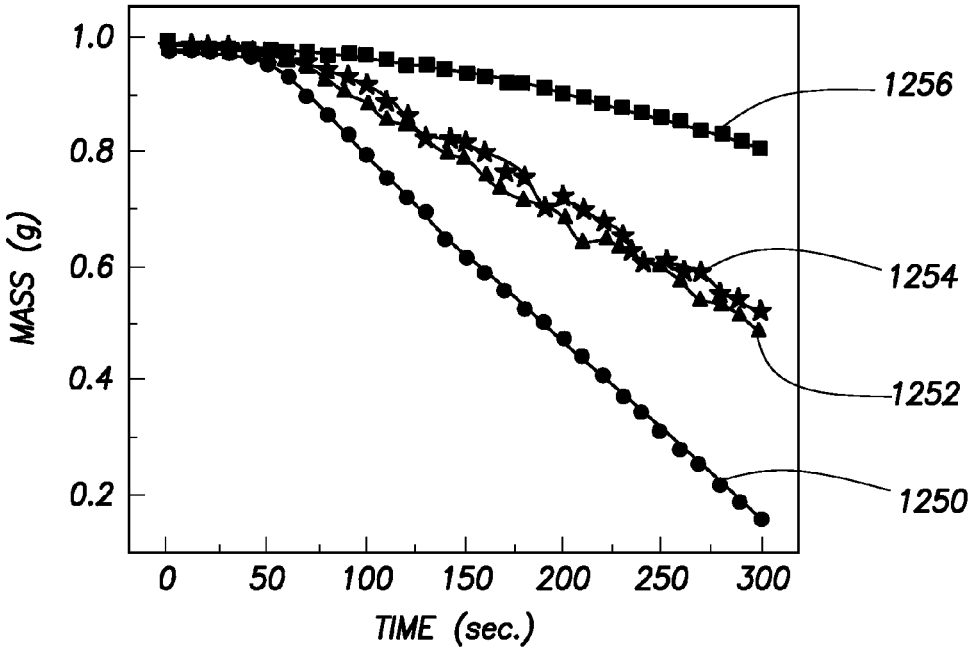
Figure 12C:
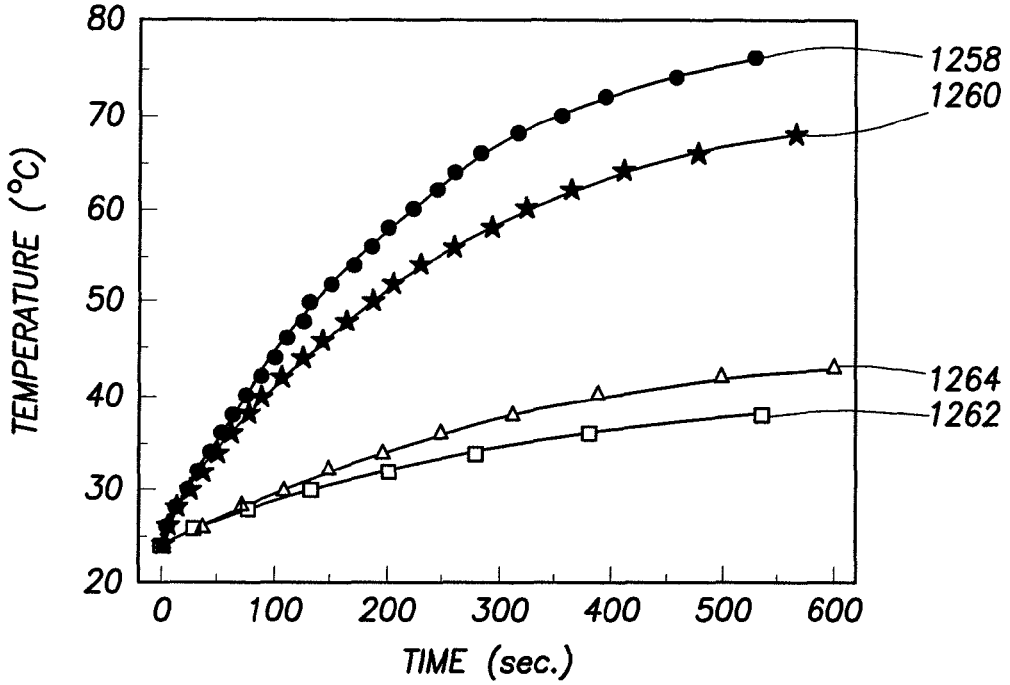

FIGS. 12A-12C show charts of the mass loss and temperature increase of different nanostructures that may be used in a complex in accordance with one or more embodiments of the invention. The results shown in FIGS. 12A-12C were performed to monitor the mass loss of an aqueous nanostructure solution for 10 minutes under sunlight (FIG. 12B) versus non-pulsed diode laser illumination at 808 nm (FIG. 12A). In FIG. 12A, the mass loss versus time of the laser illumination at 808 nm is shown for $Eu_2O_3$-coated nanoshells 1244, non-coated gold nanoshells 1246, and gold nanoparticles with a diameter of ~100 nm 1248. Under laser exposure, as may be expected from the absorbance shown in FIG. 3, at 808 nm illumination, the coated and non-coated nanoshells exhibit a mass loss due to the absorbance of the incident electromagnetic radiation at 808 nm. In addition, as the absorbance is lower at 808 nm, the 100 nm diameter gold colloid exhibits little mass loss at 808 nm illumination. In FIG. 12A, the Au nanoparticles demonstrated a lower loss rate that was nearly the same as water because the laser wavelength was detuned from plasmon resonance frequency. The greatest mass loss was obtained by adding a layer around the gold nanoshells, where the particle absorption spectrum was approximately the same as the solar spectrum (see FIG. 3.)

In FIG. 12B, the mass loss as a function of time under exposure to the sun in accordance with one or more embodiments of the invention is shown. In FIG. 12B, the mass loss under sun exposure with an average power of 20 W is shown for $Eu_2O_3$-coated nanoshells 1250, non-coated gold nanoshells 1252, gold nanoparticles with a diameter of ~100 nm 1254, and a water control 1256. As in the previous example, the greatest mass loss may be obtained by adding a rare earth or dielectric layer around a nanoshell.

The resulting mass loss curves in FIGS. 12A and 12B show significant water evaporation rates for $Eu_2O_3$-coated gold nanoshells. The mass loss may be slightly greater under solar radiation because the particles were able to absorb light from a broader range of wavelengths. In addition, the collective effect of aggregates broadens the absorption spectrum of the oxide-coated nanoparticles, which may help to further amplify the heating effect and create local areas of high temperature, or local hot spots. Aggregates may also allow a significant increase in boiling rates due to collective self organizing forces. The oxide layer may further enhance steam generation by increasing the surface area of the nanoparticle, thus providing more boiling nucleation sites per particle, while conserving the light-absorbing properties of the nanostructure.

FIG. 12C shows the temperature increase versus time under the 808 nm laser exposure in accordance with one or more embodiments of the invention. In FIG. 12C, the temperature increase under the 808 nm laser exposure is shown for $Eu_2O_3$-coated nanoshells 1258, non-coated gold nanoshells 1260, gold nanoparticles with a diameter of ~100 nm 1262, and a water control 1264. As may be expected, the temperature of the solutions of the different nanostructures that may be included in the complex increases due to the absorption of the incident electromagnetic radiation of the specific nanostructure and the conversion of the absorbed electromagnetic radiation into heat.

Figure 13B:
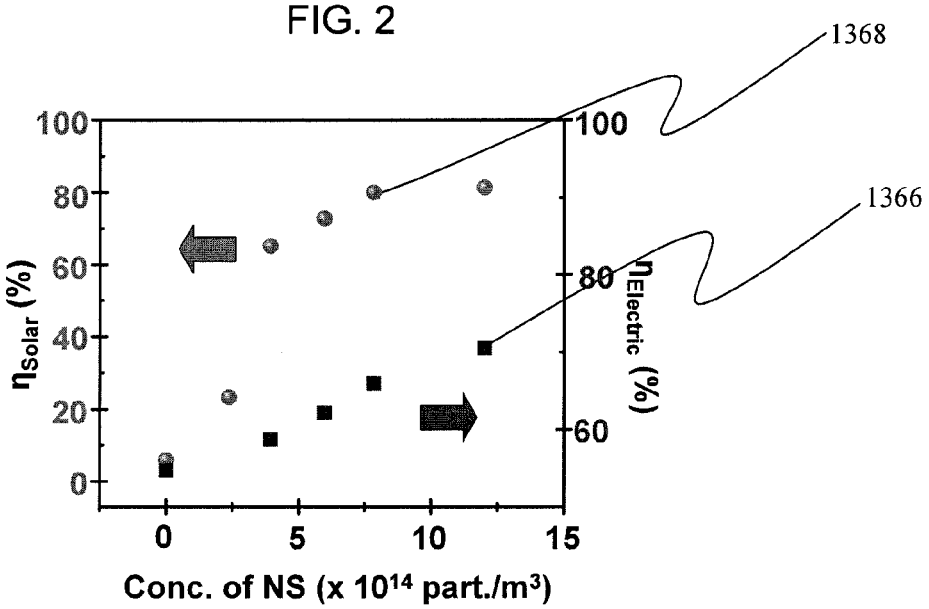
FIGS. 13A-13B show charts of the energy capture efficiency in accordance with one or more embodiments of the invention.
Figure 13A:
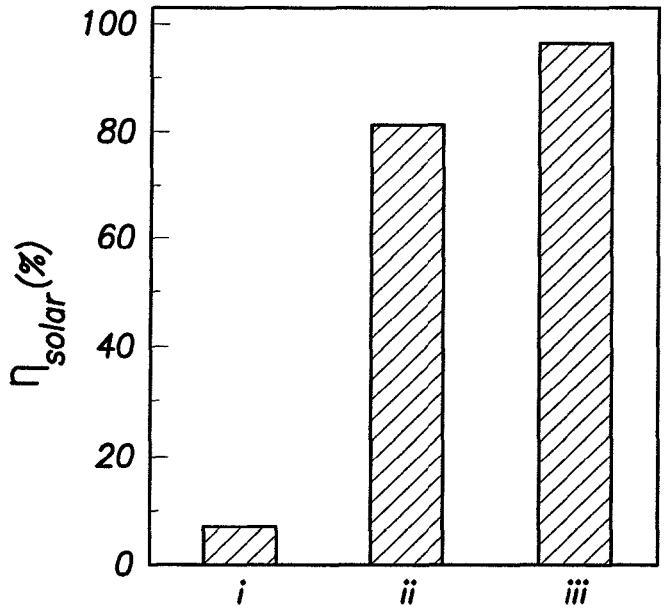

FIG. 13A is a chart of the solar trapping efficiency in accordance with one or more embodiments of the invention. To quantify the energy trapping efficiency of the complex, steam is generated in a flask and throttled through a symmetric convergent-divergent nozzle. The steam is then cooled and collected into an ice bath maintained at 0° C. The nozzle serves to isolate the high pressure in the boiler from the low pressure in the ice bath and may stabilize the steam flow. Accordingly, the steam is allowed to maintain a steady dynamic state for data acquisition purposes. In FIG. 13A, the solar energy capture efficiency (η) of water (i) and Eu2O3-coated nanoshells (ii) and gold branched (ii) nanostructures is shown. The resulting thermal efficiency of steam formation may be estimated at 80% for the coated nanoshell complex and 95% for a gold branched complex. By comparison, water has approximately 10% efficiency under the same conditions.

In one or more embodiments of the invention, the concentration of the complex may be modified to maximize the efficiency of the system. For example, in the case where the complex is in solution, the concentration of the different nanostructures that make up the complex for absorbing EM radiation may be modified to optimize the absorption and, thus, optimize the overall efficiency of the system. In the case where the complex is deposited on a surface, the surface coverage may be modified accordingly.

In FIG. 13B, the steam generation efficiency versus gold nanoshell concentration for solar and electrical heating in accordance with one or more embodiments of the invention is shown. The results show an enhancement in efficiency for both electrical 1366 and solar 1368 heating sources, confirming that the bubble nucleation rate increases with the concentration of complex. At high concentrations, the complex is likely to form small aggregates with small interstructure gaps. These gaps may create "hot spots", where the intensity of the electric field may be greatly enhanced, causing an increase in temperature of the surrounding water. The absorption enhancement under electrical energy 1366 is not as dramatic as that under solar power 1368 because the solar spectrum includes energetic photons in the NIR, visible and UV that are not present in the electric heater spectrum. At the higher concentrations, the steam generation efficiency begins to stabilize, indicating a saturation behavior. This may result from a shielding effect by the particles at the outermost regions of the flask, which may serve as a virtual blackbody around the particles in the bulk solution.

Figure 14:
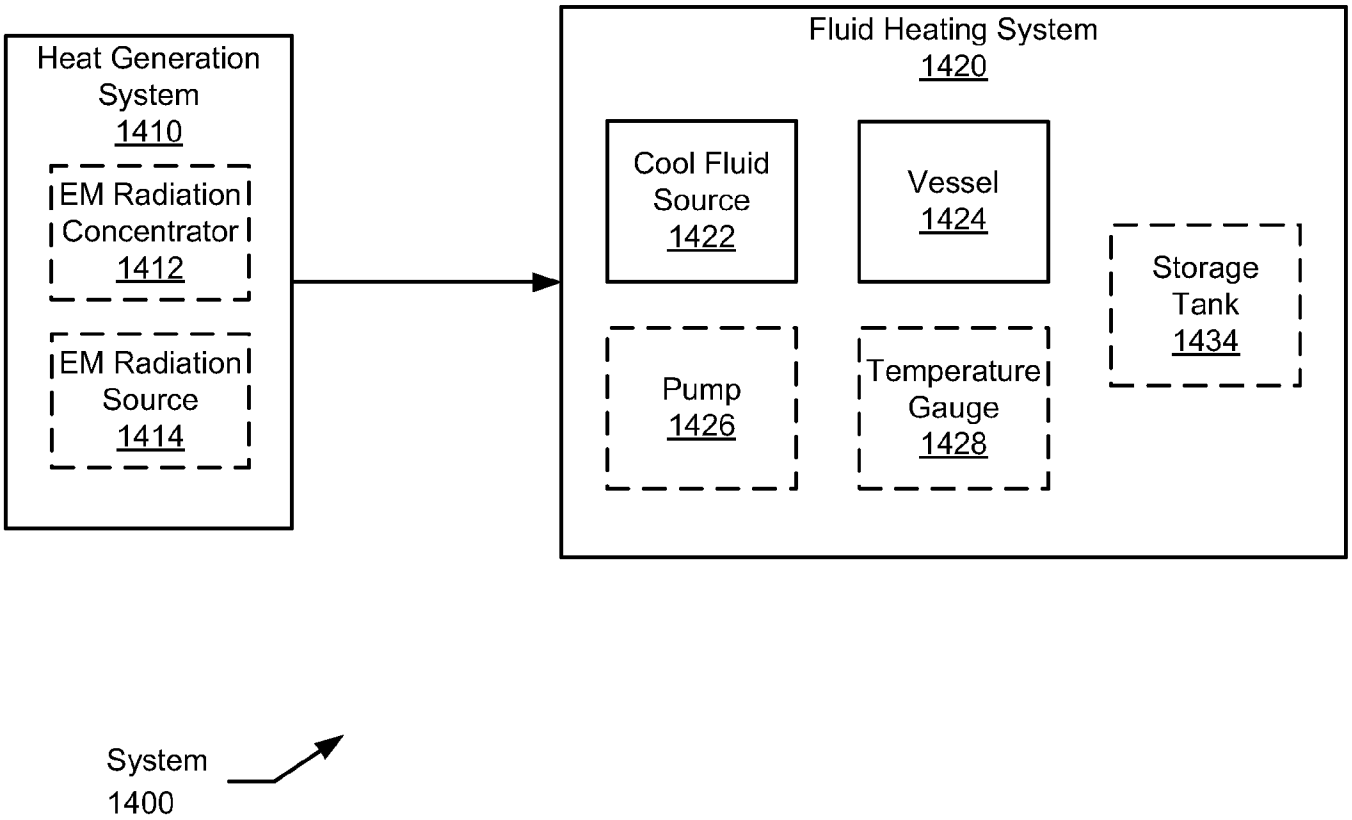
FIG. 14 shows a system in accordance with one or more embodiments of the invention.

FIG. 14 shows a system 1400 using a complex in accordance with one or more embodiments of the invention. The system 1400 includes a heat generation system 1410 and a fluid heating system 1420. The heat generation system 1410 includes, optionally, an EM radiation source 1414 and an EM radiation concentrator 1412. The target fluid processing system 1420 includes a cool fluid source 1422, a vessel 1424, and, optionally, a pump 1426, a temperature gauge 1428, and a storage tank 1434. Each of these components is described with respect FIG. 14 below. One of ordinary skill in the art will appreciate that embodiments of the invention are not limited to the configuration shown in FIG. 14.

Each component shown in FIG. 14, as well as any other component implied and/or described but not shown in FIG. 14, may be configured to receive material from one component (i.e., an upstream component) of the system 1400 and send material (either the same as the material received or material that has been altered in some way (e.g., cool fluid to heated fluid)) to another component (i.e., a downstream component) of the system 1400. In all cases, the material received from the upstream component may be delivered through a series of pipes, pumps, valves, and/or other devices to control factors associated with the material received such as the flow rate, temperature, and pressure of the material received as it enters the component. Further, the cool fluid and/or heated fluid may be delivered to the downstream component using a different series of pipes, pumps, valves, and/or other devices to control factors associated with the material sent such as the flow rate, temperature, and pressure of the material sent as it leaves the component.

In one or more embodiments of the invention, the heat generation system 1410 of the system 1400 is configured to provide EM radiation. The heat generation system 1410 may be ambient light, as produced by the sun or one or more light bulbs in a room. Optionally, in one or more embodiments of the invention, the EM radiation source 1414 is any other source capable of emitting EM radiation having one or a range of wavelengths. The EM radiation source 1414 may be a stream of flue gas derived from a combustion process using a fossil fuel, including but not limited to coal, fuel oil, natural gas, gasoline, and propane. In one or more embodiments of the invention, the stream of flue gas is created during the production of heat and/or electric power using a boiler to heat water using one or more fossil fuels. The stream of flue gas may also be created during some other industrial process, including but not limited to chemical production, petroleum refining, and steel manufacturing. The stream of flue gas may be conditioned before being received by the heat generation system 1410. For example, a chemical may be added to the stream of flue gas, or the temperature of the stream of flue gas may be regulated in some way. Conditioning the stream of flue gas may be performed using a separate system designed for such a purpose.

In one or more embodiments of the invention, the EM radiation source 1414 is any other natural and/or manmade source capable of emitting one or more wavelengths of energy. The EM radiation source 1414 may also be a suitable combination of sources of EM radiation, whether emitting energy using the same wavelengths or different wavelengths.

Optionally, in one or more embodiments of the invention, the EM radiation concentrator 1412 is a device used to intensify the energy emitted by the EM radiation source 1414. Examples of an EM radiation concentrator 1412 include, but are not limited to, one or more lenses (e.g., Fresnel lens, biconvex, negative meniscus, simple lenses, complex lenses), a parabolic trough, black paint, one or more disks, an array of multiple elements (e.g., lenses, disks), or any suitable combination thereof. The EM radiation concentrator 1412 may be used to increase the rate at which the EM radiation is absorbed by the complex.

In one or more embodiments of the invention, the fluid heating system 1420 of the system 1400 is configured to receive a cool fluid from a cool fluid source 1422 in a vessel 1424 to generate a heated fluid. The cool fluid source 1422 is where the cool fluid originates. In one or more embodiments of the invention, the cool fluid source 1422 includes a mixture of the cool fluid and other elements (e.g., impurities). The cool fluid source 1422 may be any type of source, including but not limited to a pond, a stream, a storage tank, and an output of a chemical process. The cool fluid may be any type of fluid. Examples of a cool fluid include, but are not limited to, water (salt, brackish, well, distilled, drinking, etc.), oil, and acid.

In one or more embodiments of the invention, the vessel 1424 holds the cool fluid and facilitates the transfer of energy (e.g., heat) to the cool fluid to generate heated fluid. The vessel 1424, or a portion thereof, may include the complex. For example, the vessel 1424 may include a liquid solution (or some other material, liquid or otherwise, such as ethylene glycol or glycine) that includes the complex, be coated on one or more inside surfaces with a coating of the complex, be coated on one or more outside surfaces with a coating of the complex, include a porous matrix into which the complex is embedded, include a packed column that includes packed, therein, a substrate on which the complex is attached, include rods or similar objects coated with the complex and submerged in the fluid and/or liquid solution, be constructed of a material that includes the complex, or any combination thereof. The vessel 1424 may also be adapted to facilitate one or more EM radiation concentrators (not shown), as described above.

The vessel 1424 may be of any size, material, shape, color, degree of translucence/transparency, or any other characteristic suitable for the operating temperatures and pressures to produce the amount and type of heated fluid designed for the application. For example, the vessel 1424 may be a large, stainless steel cylindrical tank holding a quantity of solution that includes the complex and with a number of lenses (acting as EM radiation concentrators) along the lid and upper walls. In such a case, the solution may include the cool fluid to be heated into the heated fluid. Further, in such a case, the cool fluid includes properties such that the complex remains in the solution when a filtering system (described below) is used. Alternatively, the vessel 1424 may be a translucent pipe with the interior surfaces coated (either evenly or unevenly) with a substrate of the complex, where the pipe is positioned at the focal point of a parabolic trough (acting as an EM radiation concentrator) made of reflective metal.

Optionally, in one or more embodiments of the invention, the vessel 1424 includes one or more temperature gauges 1428 to measure a temperature at different points inside the vessel 1424. For example, a temperature gauge 1428 may be placed at the point in the vessel 1424 where the heated fluid exits the vessel 1424. Such temperature gauge 1428 may be operatively connected to a control system (not shown) used to control the amount and/or quality of heated fluid produced in heating the cool fluid. In one or more embodiments of the invention, the vessel 1424 may be pressurized where the pressure is read and/or controlled using a pressure gauge (not shown). Those skilled in the art will appreciate one or more control systems used to create heated fluid in heating the cool fluid may involve a number of devices, including but not limited to the temperature gauge(s) 1428, pressure gauges, pumps (e.g., pump 1426), fans, and valves, controlled (manually and/or automatically) according to a number of protocols and operating procedures. In one or more embodiments of the invention, the control system may be configured to maintain a maximum temperature (or range of temperatures) of the vessel 1424 so that the heated fluid maintains (or does not exceed) a predetermined temperature. For example, a control system may be used when the heated fluid is water to ensure that the temperature of the heated water, to be used for a shower/bathtub, does not exceed 105 degrees Fahrenheit.

Optionally, in one or more embodiments of the invention, one or more of the components of the fluid heating system 1420 may also include a filtering system (not shown). For example, a filtering system may be located inside the vessel 1424 and/or at some point before the cool fluid enters the vessel 1424. The filtering system may capture impurities (e.g., dirt, large bacteria, corrosive material) in the cool fluid that are not useful or wanted in the heated fluid. The filtering system may vary, depending on a number of factors, including but not limited to the configuration of the vessel 1424, the configuration of the cool fluid source 1422, and the purity requirements of the heated fluid. The filtering system may be integrated with a control system. For example, the filtering system may operate within a temperature range measured by one or more temperature gauges 1428.

Optionally, in one or more embodiments of the invention, one or more pumps 1426 may be used in the fluid heating system 1420. A pump 1426 may be used to regulate the flow of the cool fluid into the vessel 1424 and/or the flow of the heated fluid from the vessel 1424. A pump 1426 may operate manually or automatically (as with a control system, described above). Each pump 1426 may operate using a variable speed motor or a fixed speed motor. The flow of cool fluid and/or heated fluid may also be controlled by gravity, pressure differential, some other suitable mechanism, or any combination thereof.

Optionally, in one or more embodiments of the invention, the storage tank 1438 of the fluid heating system 1430 is configured to store the heated fluid after the heated fluid has been extracted from the vessel 1424. In some embodiments of the invention, the storage tank may be the vessel 1424, as shown below in FIG. 21.

Figure 15:
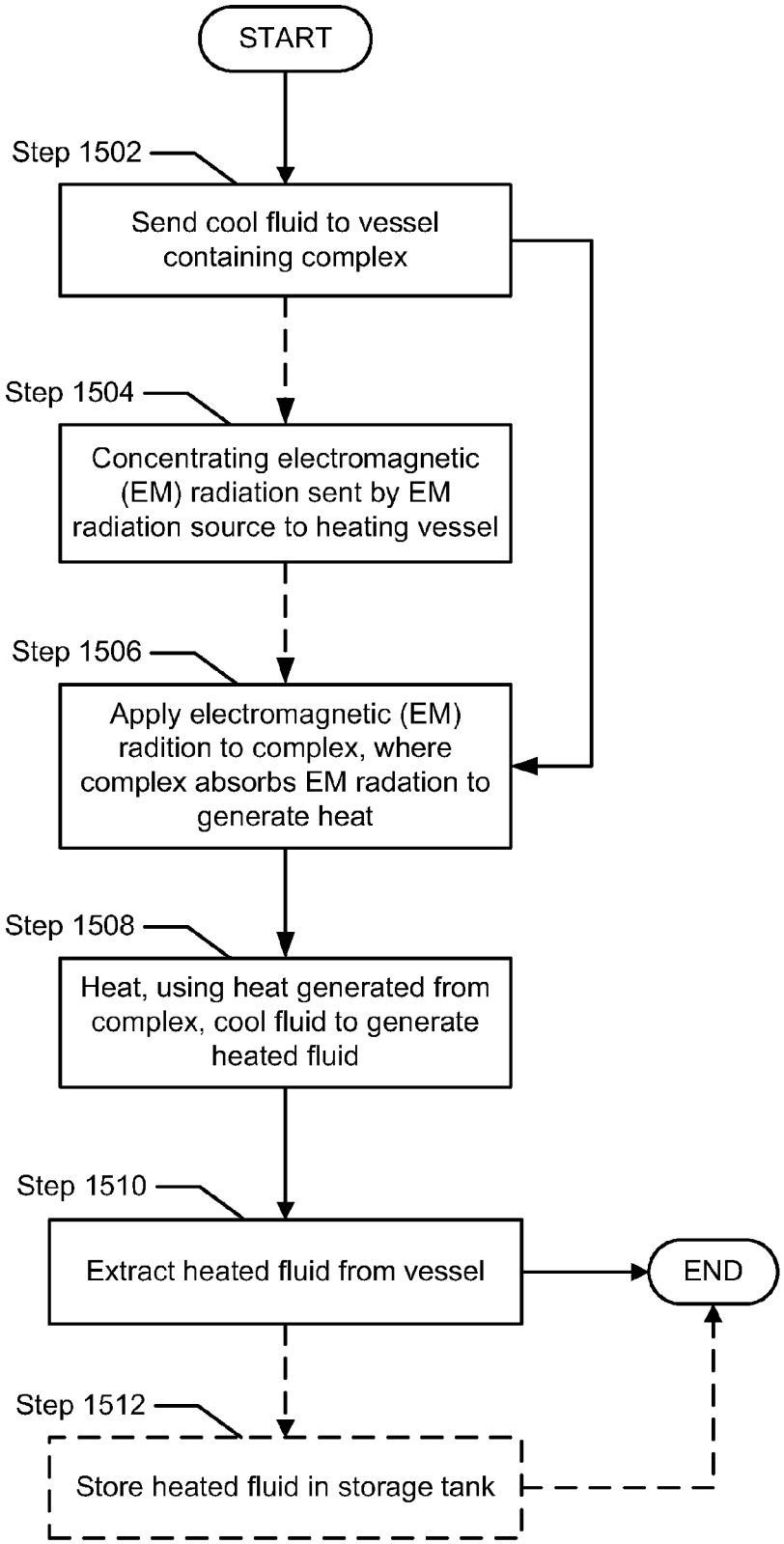
FIG. 15 shows a flowchart for a method of generating a heated fluid in accordance with one or more embodiments of the invention.

FIG. 15 shows a flowchart for a method for heating a cool fluid in accordance with one or more embodiments of the invention. While the various steps in this flowchart are presented and described sequentially, one of ordinary skill will appreciate that some or all of the steps may be executed in different orders, may be combined or omitted, and some or all of the steps may be executed in parallel. Further, in one or more of the embodiments of the invention, one or more of the steps described below may be omitted, repeated, and/or performed in a different order. In addition, a person of ordinary skill in the art will appreciate that additional steps, omitted in FIG. 15, may be included in performing this method. Accordingly, the specific arrangement of steps shown in FIG. 15 should not be construed as limiting the scope of the invention.

Referring to FIG. 15, in Step 1502, a cool fluid is sent to a vessel. In one or more embodiments of the invention, the vessel includes a complex. The cool fluid may be any liquid. The vessel may be any container capable of holding a volume of the cool fluid. For example, the vessel may be a pipe, a chamber, or some other suitable container. In one or more embodiments of the invention, the vessel is adapted to maintain its characteristics (e.g., form, properties) under high temperatures for extended periods of time. The complex may be part of a solution inside the vessel, a coating on the outside of the vessel, a coating on the inside of the vessel, integrated as part of the material of which the vessel is made, integrated with the vessel in some other way, or any suitable combination thereof. The cool fluid may be received in the vessel using gravity, pressure differential, a pump, a valve, a regulator, some other device to control the flow of the cool fluid, or any suitable combination thereof.

Optionally, in Step 1504, EM radiation sent by an EM radiation source (described above with respect to FIG. 14) to the vessel is concentrated. In one or more embodiments of the invention, the EM radiation is concentrated using an EM radiation concentrator, as described above with respect to FIG. 14. For example, the EM radiation may be concentrated using one or more lenses or a parabolic trough. In one or more embodiments of the invention, the EM radiation is concentrated merely by exposing the vessel to the EM radiation.

In Step 1506, the EM radiation is applied to the complex. In one or more embodiments of the invention, the complex absorbs the EM radiation to generate heat. The EM radiation may be applied to all or a portion of the complex contained in the vessel. The EM radiation may also be applied to an intermediary, which in turn applies the EM radiation (either directly or indirectly, as through convection) to the complex. A control system using, for example, one or more temperature gauges, may regulate the amount of EM radiation applied to the complex, thus controlling the amount of heat generated by the complex at a given point in time. Power required for any component in the control system may be supplied by any of a number of external sources (e.g., a battery, a photovoltaic solar array, alternating current power, direct current power).

In Step 1508, the cool fluid is heated to generate heated fluid. In one or more embodiments of the invention, the cool fluid is heated using the heat generated by the complex. A control system may be used to monitor and/or regulate the temperature of the heated fluid.

In Step 1510, the heated fluid is extracted from the vessel. In one or more embodiments of the invention, a pump is used to extract the fluid from the vessel. The pump may be controlled by a control system. For example, the pump may operate when the heated fluid reaches a threshold temperature inside the vessel, as read by a temperature gauge. After completing Step 1510, the process ends. Optionally, the process may proceed to Step 1512, where the heated fluid is stored in a storage tank.

FIGS. 16 through 21 show examples of various embodiments of the invention. While the examples below with respect to FIGS. 16 through 21 describe applications for water, those skilled in the art will appreciate that applications for other fluids, such as oil, acids, and other chemicals, are equally applicable. For example, embodiments of the invention may be used to heat oil for deep frying and similar cooking applications.

Figure 16:
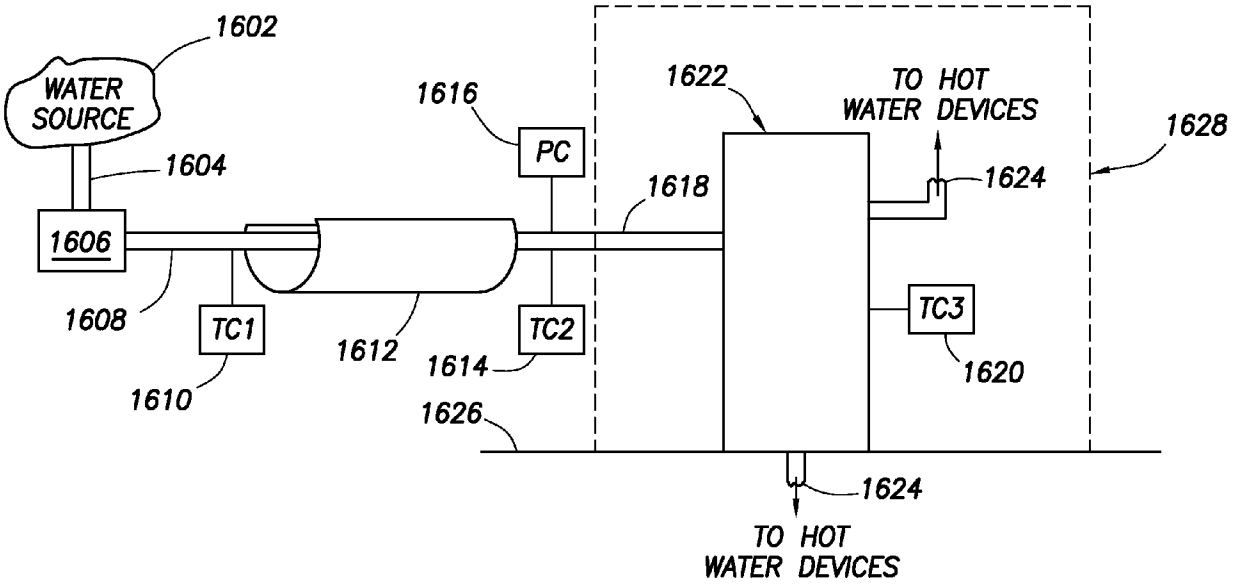
FIGS. 16 through 21 each show a single line diagram of an example system for heating a cool fluid in accordance with one or more embodiments of the invention.

Consider the following example, shown in FIG. 16, which describes a process for heating a cool fluid in accordance with one or more embodiments described above. In this example, the cool fluid (i.e., water) originates from a water source 1602. The water source may be any source of water, including but not limited to a stream, a lake, a pond, an underground well, a water tower, a water tank, and a swimming pool. The water may be treated or untreated. The water may be extracted from the water source 1602 using gravity, pressure differential, a pump 1606, a valve, a fan, hydraulic pressure, any other suitable method of extracting and/or moving water, or any combination thereof. In this example, a pump 1606 is used.

The water may be extracted from the water source 1602 through piping 1604 before reaching a vessel 1608 with complex. The complex may be incorporated into the vessel 1608 in one of a number of ways. For example, the complex may be applied to the inside surface of the pipe. In this case, the complex may not be applied unevenly (i.e., non-uniformly), so that a greater amount of surface area of the complex may come in direct contact with the fluid as the fluid flows through the pipe. The greater amount of surface area may allow for a greater transfer of heat from the pipe to the heating fluid. The complex may also be applied evenly (i.e., uniformly) to the inside surface of the pipe. Alternatively, the complex may be applied to the outer surface of the pipe as an even coating. Those skilled in the art will appreciate that integrating the complex with the pipe (or any other form of heating fluid vessel) may occur in any of a number of other ways. The complex is configured to absorb EM radiation from an EM radiation source (not shown). Upon absorbing the EM radiation, the complex generates heat. When an EM radiation concentrator is used, as with the parabolic trough 1612 shown in FIG. 16, the EM radiation absorbed by the complex becomes more intense, which increases the heat generated by the complex.

The water, which flows inside the pipe of the vessel 1608, receives the heat generated by the complex at the inner wall of the pipe. To regulate the temperature of the heated water in the vessel 1608, a control system may be used. The control system may be integrated with the control of the extraction and flow of the water, if any, from the water source 1602, described above. To control the temperature of the heated water, a number of different instruments may be used. For example, temperature gauges, pressure gauges, photocells, pumps, fans, and other devices may be used, either separately or in combination. In this example, a pump 1606, two temperature gauges (i.e., TC1 1610 and TC2 1614), and a photocell (i.e, PC 1616) are used. Specifically, TC1 1610 measures the temperature of the cool water just before the cool water reaches the vessel 1608 with the complex. As the heated water leaves the vessel 1608 with the complex, TC2 1614 measures the temperature of the heated water. In addition, PC 1616 measures the intensity of the source of the EM radiation, which in this example may be sunlight from the sun. The readings from TC1 1610, TC2 1614, and PC 1616, as well as the flow rate of the water through the vessel 1608 derived from the speed of the pump 1606, may allow the control system to adjust one or more operating factors to meet designated parameters. For example, if the temperature of the heated water is too low at TC2 1614, the control system may reduce the speed of the variable speed motor controlling the pump 1606.

Upon leaving the vessel 1608, the heated water flows through a pipe 1618 to be stored in a storage tank 1622. The storage tank 1622 may be insulated to retain a portion of the heat from the heated water. In one or more embodiments of the invention, the storage tank 1622 may also be controlled by a control system, as described above for the vessel 1608. For example, the control system may use a temperature gauge (i.e., TC3 1620) to measure the temperature of the heated water in the storage tank 1622 and make appropriate operating changes (e.g., vent some of the excess heat, request more heated water at a higher temperature) as necessary. The storage tank 1622 may be stored in an enclosed location 1628, such as a utility room or closet, an attic, a kitchen pantry, or any other suitable location. The storage tank 1622 may have one or more piping feeds 1624 to devices that use heated water. Examples of such devices may include, but are not limited to, a shower, a faucet, a dishwasher, a washing machine, a swimming pool, a hot tub, a dry cleaner, a chemical process, and a steam sauna. The storage tank 1622 may rest on a platform 1626, such as a floor or the ground.

In embodiments of the invention, a filtering system (not shown) may be integrated with the vessel 1608 to remove certain impurities (e.g., dirt, solids, large bacteria) from the mixture. Similar filtering systems may also be used in other portions of this system.

Figure 17:
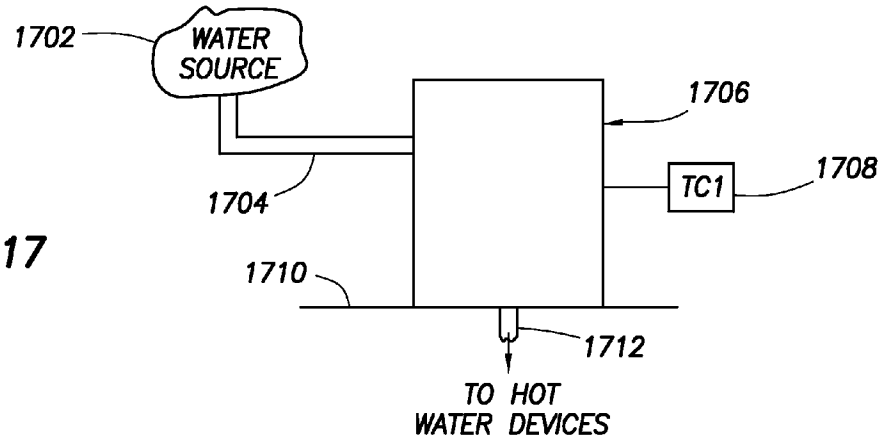

As discussed above, the process of heating the cool fluid to generate heated fluid may occur in a number of ways other than the way shown in FIG. 16. Specifically, the vessel may take any of a number of forms. Further examples of various heating fluid vessels and its applications are shown in FIGS. 17 through 21. For example, FIG. 17 shows a rooftop application for heating water. In this case, the vessel 1706 is a tank coated with complex incorporated into the tank. For example, the complex may be integrated with the material from which the vessel 1706 is made. The complex may also be coated on one or more interior surfaces of the vessel 1706, floating in the cool water in the vessel 1706, incorporated in some other matter with the vessel 1706, or any combination thereof.

The water source 1702 and piping 1704 may be the same as the water source and piping described above with respect to FIG. 16. Further, the flow of water from the water source 1702 to the vessel 1706, as well as from the vessel 1706 to devices using the heated water, may be controlled by a control system (not shown), as described above with respect to FIG. 16. For example, a temperature gauge (e.g., TC1 1708) may be used to provide temperature information with respect to the heated water to the control system.

The vessel 1706 may also include a concentrator. In this example, the concentrator may be, for example, black paint on the exterior of the vessel 1706, a reflective mirror at the base of the vessel 1706, some other suitable means of concentrating the EM radiation on the vessel 1706, or any combination thereof. As EM radiation emitted from an EM radiation source (not shown) is concentrated by the concentrator (if any) and contacts the complex, the complex absorbs the EM radiation and generates heat. The heat generated by the complex radiates to the cool water inside the vessel 1706 and heats the cool water to generate heated water. The heated water is then moved from the vessel 1706 to devices using the heated water through piping 1712.

Embodiments of the invention as shown in FIG. 17 may be used by commercial and industrial entities that have flat rooftop space and a need for heated water. For example, prisons, hospitals, factories, power plants, hotels, resorts, community centers, camps and retreat facilities, and chemical plants may have multiple needs for heated water generated by embodiments of the invention.

Figure 18:
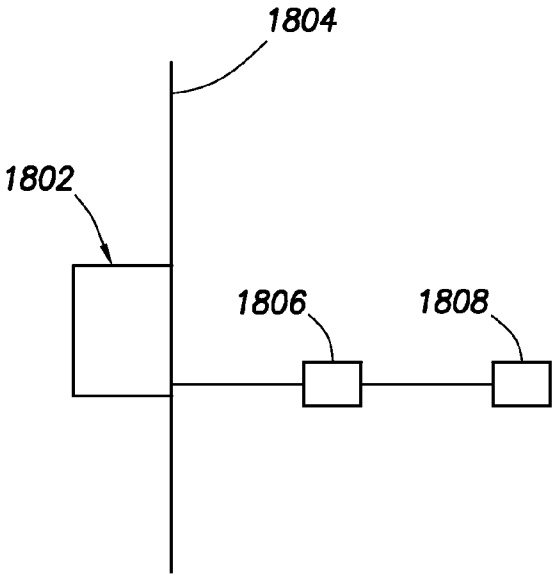

FIG. 18 shows an example application of embodiments of the invention used in conjunction with a tankless water heater, as found in residential and commercial buildings. Specifically, a vessel 1802 in embodiments of the invention may be mounted on an exterior wall 1804 and/or a roof of a building in a location proximate to a tankless water heater 1806. At times, tankless water heaters overcompensate in heating water on demand, resulting in scalding water that is too hot for the device 1808 (e.g., shower, faucet water). By incorporating heated water from the vessel 1802, when the tankless water heater 1806 receives a signal that heated water is to be sent to a device 1808, the tankless water heater 1806 may send a signal to the vessel 1802 to release heated water to the device 1808 until the tankless water heater 1806 has properly regulated the temperature of the heated water.

In this example, the vessel 1802, as well as the control system, the water source, the piping, and other components of the heated water system (all not shown) would operate in a substantially similar manner as with similar components described above with respect to FIGS. 16 and 17.

Figure 19:
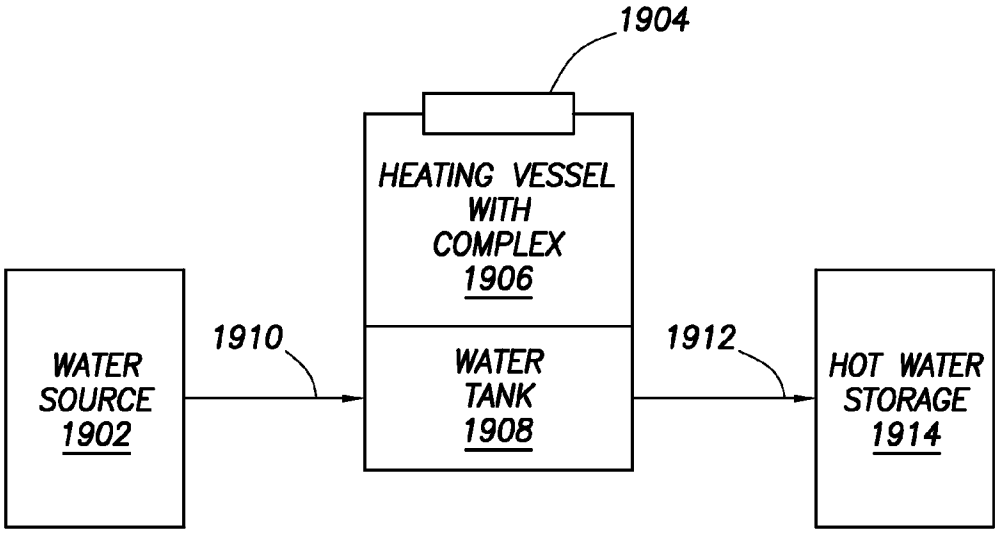

FIG. 19 shows an example of an embodiment of the invention where a heating vessel with complex 1906 is coupled to a water tank 1908. The top compartment (i.e., the heating fluid vessel 1906) may contain a heating fluid (e.g., ethylene glycol) mixed with a complex. Alternatively, the complex may otherwise be incorporated to the heating vessel 1906, as previously described herein. In this example, the heating vessel 1906 also includes a concentrator 1904. Here, the concentrator 1904 is a lens located at the top end of the heating vessel 1906. As EM radiation emitted from an EM radiation source (not shown) is concentrated by the concentrator 1904 and contacts the heating fluid, the complex absorbs the EM radiation and generates heat.

The bottom compartment (i.e., water tank 1908) shown in FIG. 19 receives cool water through piping 1910 from a water source 1902. The heat emitted from the complex in the heating vessel 1906 is radiated through the bottom of the heating vessel 1906 to the top of the water tank 1908. This radiated heat heats the cool water in the water tank 1908 to generate heated water. The heated water is then moved from the water tank 1908 to hot water storage 1914. In embodiments of the invention, the heating vessel 1906 and the water tank 1908 may be detachable, as for a portable fluid heating device. In this example, the heating vessel 1906, as well as the control system, the water source 1902, the piping, the hot water storage 1914, and other components of the heated water system (not shown unless otherwise designated) would operate in a substantially similar manner as with similar components described above with respect to FIGS. 16 and 17.

Figure 20:
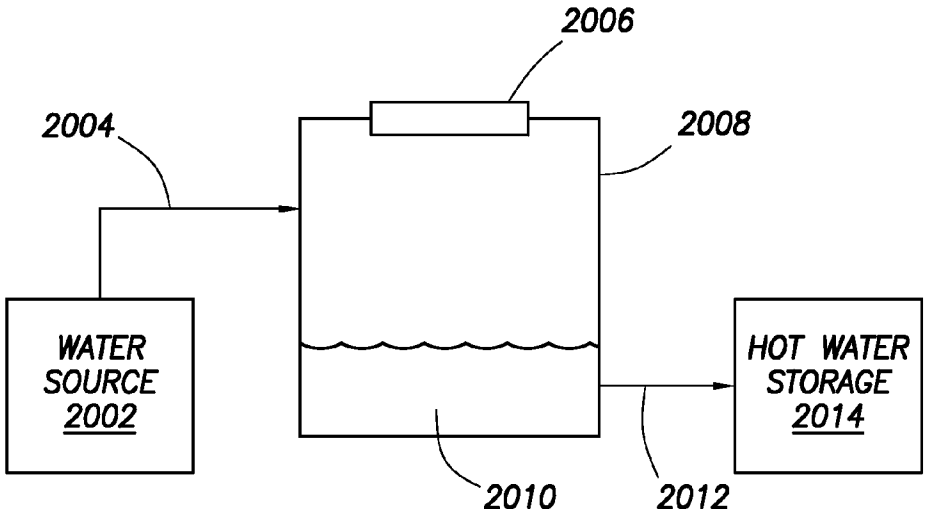

FIG. 20 shows an example of an embodiment of the invention that is substantially similar to the embodiment shown in FIG. 17. However, the embodiment of the invention shown in FIG. 20 applies more toward portable applications and/or applications using small quantities of heater water. In this example, the vessel 2008 includes cool water received through piping 2004 from a water source 2002. The cool water that collects inside the vessel 2008 is mixed with complex, which absorbs the EM radiation received from an EM radiation source (not shown). In this example, the vessel 2008 also includes a concentrator 2006. Here, the concentrator 2006 is a lens located at the top end of the vessel 2008. As EM radiation emitted from an EM radiation source (not shown) is concentrated by the concentrator 2006 and contacts the cool water with the complex, the complex absorbs the EM radiation and generates heat. The heat generated by the complex converts the cool water to heated water. The heated water is then sent to hot water storage 2014 through piping 2012. In this example, the vessel 2008, as well as the control system, the water source 2002, the piping (e.g., 2004, 2012), the hot water storage 2014, and other components of the heated water system (not shown) would operate in a substantially similar manner as with similar components described above with respect to FIGS. 16 and 17.

Figure 21:
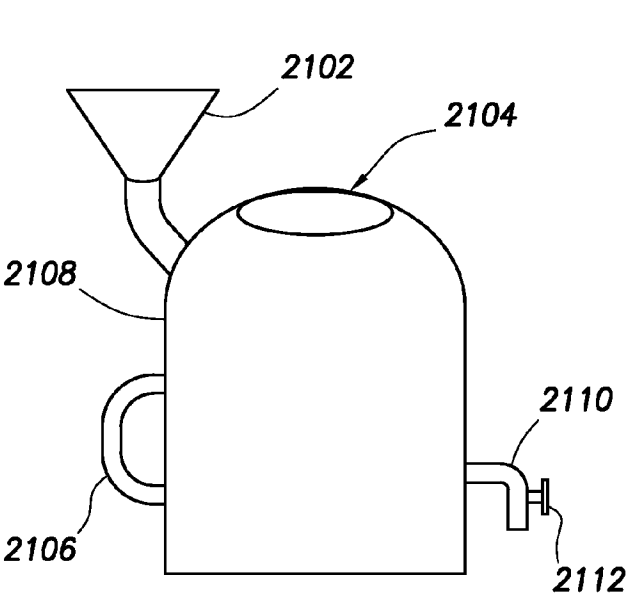

FIG. 21 shows an example of an embodiment of the invention for portable use. The components of the system shown in FIG. 21 are substantially similar to those shown and described above with respect to FIG. 20. Specifically, the system of FIG. 21 includes piping and a funnel 2102 into which water may be poured so that the water may enter the vessel 2108. The vessel 2108 may incorporate the complex in any of a number of ways already described herein. The vessel 2108 also includes a concentrator 2104 as a lens that is incorporated into the top portion of the vessel 2108. The vessel 2108 may also include one or more handles 2106 with which to carry the vessel 2108. The vessel 2108 may further include a spout 2110 with a valve 2112 to allow for controlled removal of the heated water from the vessel 2108. Applications for the embodiment of the invention shown in FIG. 21 may include, but are not limited to, camping, remote travel, disaster relief, and boating.

One or more embodiments of the invention heat a cool fluid extracted from a cool water source. The amount of cool fluid that is heated by embodiments of the invention may range from a few ounces to thousands of gallons (or more) of heated fluid. Embodiments of the invention may be portable, allowing for mobile and temporary applications. For example, in addition to examples previously discussed herein, embodiments of the invention may be used by relief workers to supply heated water to areas struck by a natural disaster, remote locations that have little or no utilities, or some other similar location needing heated water. Embodiments of the invention may also be used in neglected areas of population where adequate and reliable sources of heated water may be problematic. Embodiments of the invention may also be used to heat some other compound or chemical, such as oil, gasoline, an acid, and an alcohol.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vessel, comprising:

a concentrator configured to concentrate electromagnetic (EM) radiation received from an EM radiation source; and a complex configured to absorb EM radiation to generate heat, wherein the vessel is configured to:

receive a cool fluid from the cool fluid source, concentrate the EM radiation using the concentrator, apply the EM radiation to the complex, and transform, using the heat generated by the complex, the cool fluid to a heated fluid, wherein the complex comprises:

a carbon moiety, and an encapsulating dielectric layer configured to maintain a plasmon resonance of the complex.

2. The vessel of claim 1, further comprising:

a valve configured to control flow of the heated fluid from the vessel; and a first temperature gauge configured to measure a temperature inside the vessel, wherein the valve opens to release the heated fluid from the vessel when the temperature read by the first temperature gauge is above a temperature threshold, wherein the valve and the temperature gauge are controlled by a control system, wherein the control system comprises a photocell and a second temperature gauge, which, when used with the first temperature gauge determines a speed at which a pump operates to achieve a target temperature of the heated fluid.

3. The vessel of claim 1, wherein the concentrator is a lens.

4. The vessel of claim 1, wherein the concentrator is a parabolic trough and wherein the vessel is a section of pipe coated with the complex.

5. The vessel of claim 1, wherein the complex is coated on an interior of the vessel.

6. The vessel of claim 1, wherein the complex is suspended in the fluid in the vessel.

7. The vessel of claim 1, wherein the vessel is portable.

8. The vessel of claim 1, wherein the complex further comprises a second carbon moiety that is aggregated to the carbon moiety to form an aggregate.

9. The vessel of claim 8, wherein the aggregate has a broader absorption spectrum relative to an absorption spectrum of the carbon moiety or an absorption spectrum of the second carbon moiety.

10. The vessel of claim 9, wherein the absorption spectrum of the carbon moiety is different than an absorption spectrum of the second carbon moiety.

11. The vessel of claim 8, wherein the carbon moiety has a first structure, wherein the second carbon moiety has a second structure, wherein the first structure and the second structure are different structures.

12. The vessel of claim 1, wherein a thermal efficiency of steam formation by the complex is at least 80%.

13. The vessel if claim 1, wherein the complex is supported on a polymer film, thereby fixing the complex to a surface.

* * * * *